US005720341A

United States Patent [19]

Watanabe et al.

[11] Patent Number: 5,720,341

[45] Date of Patent: Feb. 24, 1998

[54] STACKED-TYPED DUPLEX HEAT EXCHANGER

[75] Inventors: Mikio Watanabe, Oyamashi; Takayuki Yasutake, Minamikawachimachi; Shoichi Watanabe, Oyamashi; Yuji Hasegawa, Utsunomiyashi, all of Japan

[73] Assignee: Showa Aluminum Corporation, Osaka, Japan

[21] Appl. No.: 747,509

[22] Filed: Nov. 12, 1996

Related U.S. Application Data

[63] Continuation of Ser. No. 420,371, Apr. 11, 1995, abandoned.

[30] Foreign Application Priority Data

Apr. 12, 1994 [JP] Japan ..... 6-073276
Aug. 31, 1994 [JP] Japan ..... 6-207332

[51] Int. Cl.[6] ..... F28F 13/00; F28D 1/03

[52] U.S. Cl. ..... 165/135; 165/67; 165/140; 165/153; 165/167

[58] Field of Search ..... 165/67, 135, 140, 165/153, 167

[56] References Cited

U.S. PATENT DOCUMENTS

| | | | |
|---|---|---|---|
| 2,619,329 | 11/1952 | Newhall | 165/167 X |
| 4,011,905 | 3/1977 | Milllard | 165/153 X |
| 4,651,816 | 3/1987 | Struss et al. | 165/76 |
| 5,033,540 | 7/1991 | Tategami et al. | 165/135 |
| 5,076,354 | 12/1991 | Nishishita . | |
| 5,176,205 | 1/1993 | Anthony | 165/153 X |
| 5,180,004 | 1/1993 | Nguyen | 165/140 |
| 5,186,244 | 2/1993 | Joshi | 165/135 |
| 5,205,484 | 4/1993 | Susa et al. | 236/35.3 |
| 5,219,016 | 6/1993 | Bolton et al. | 165/67 X |
| 5,269,367 | 12/1993 | Susa et al. | 165/41 |

FOREIGN PATENT DOCUMENTS

| | | | |
|---|---|---|---|
| 532166 | 10/1954 | Belgium | 165/167 |
| 0 367 078 | 10/1989 | European Pat. Off. . | |
| 0 431 917 | 12/1990 | European Pat. Off. . | |
| 0 584 806 A1 | 3/1994 | European Pat. Off. . | |
| 0 590 306 A1 | 4/1994 | European Pat. Off. . | |
| 3542189 | 6/1987 | Germany | 165/140 |
| 993 | 1/1981 | Japan | 165/140 |
| 62-218794 | 9/1987 | Japan . | |
| 64-4575 | 2/1989 | Japan . | |
| 1-247990 | 10/1989 | Japan . | |
| 2-62268 | 5/1990 | Japan . | |
| 5-202748 | 8/1993 | Japan . | |
| 5-215483 | 8/1993 | Japan . | |
| 5-215484 | 8/1993 | Japan . | |
| 5-231794 | 9/1993 | Japan . | |
| 660469 | 11/1951 | United Kingdom | 165/140 |
| 1027366 | 11/1963 | United Kingdom . | |

*Primary Examiner*—Leonard R. Leo
*Attorney, Agent, or Firm*—Armstrong, Westerman Hattori, McLeland & Naughton

[57] ABSTRACT

A duplex heat exchanger of the so-called stacked type has in principle a plurality of plate-shaped tubular elements (1) which are stacked side by side or one on another and a plurality of fins (2) each intervening between the adjacent tubular elements. Each tubular element is composed of flat tubular segments (3*a*, 4*a*) separated from each other and each communicating with one of bulged header portions (3*b*, 4*b*) of the tubular element, so that flow paths (3, 4) for heat exchanging media are formed through each tubular element. Two or more unit heat exchangers (X, Y) are defined integral with each other within the duplex heat exchanger, since the adjacent tubular elements (1) communicate with each other through the header portions (3*b*, 4*b*).

13 Claims, 26 Drawing Sheets

STACKED-TYPED DUPLEX HEAT EXCHANGER

This application is a continuation of application Ser. No. 08/420,371 filed Apr. 11, 1995, now abandoned.

BACKGROUND OF THE INVENTION AND RELATED ART STATEMENT

The present invention relates to a stacked-type duplex heat exchanger in which two or more unit heat exchangers such as a radiator, a condenser, an evaporator, an intercooler and an engine oil cooler are formed integral with each other.

In combination for example of the radiators for cooling automobile engines with the condensers for use in the car air-conditioning systems, they have in general been manufactured independently to be discrete units. They have usually been disposed at a frontal area in each engine room of automobile car, with the condenser being located upstreamly of the radiator.

In other words, those discrete heat exchangers have been arranged fore and aft in a narrow space of the engine room. Thus, manufacture of and a mounting work for them have been expensive and cost much labor. This drawback has been not only inherent in the combination of a condenser with a radiator but also in any other combinations of unit heat exchangers.

On the other hand, a proposal to provide a duplex heat exchanger comprising for example a condenser united with a radiator is known as disclosed in the Japanese Unexamined Patent Publication Hei. 1-247990.

A first and a second unit heat exchangers constituting such a known duplex heat exchanger are arranged fore and aft. Each unit heat exchanger is composed of a pair of spaced parallel headers and flat tubes each having both ends connected to said headers in fluid communication therewith. Each of fins intervenes between the adjacent tubes and is spanned between the unit heat exchangers so as to unite them to form the duplex heat exchanger.

Such a duplex heat exchanger is advantageous in that it can more easily be mounted on the automobile car than the separate unit heat exchangers are.

However, it is noted that there are two substantially discrete unit heat exchangers merely connected by the common fins. Manufacture efficiency has not been improved to remarkably lower manufacture cost. This is because each unit heat exchanger comprises its own pair of parallel headers and its own plurality of tubes spanned therebetween. Such a simple fore-and-aft connection of those conventional unit heat exchangers cannot necessarily meet the recent strong requirement for more compact and lighter heat exchanging apparatuses.

OBJECTS AND SUMMARY OF THE INVENTION

An object of the present invention is therefore to provide a novel duplex heat exchanger that can be manufactured at a remarkably improved efficiency and at a considerably lowered cost, wherein the duplex heat exchanger must be more compact in size and lighter in weight, for a given capacity.

The duplex heat exchanger to achieve this object does comprise in principle a plurality of plate-shaped tubular elements which are stacked side by side or one on another in the direction of their thickness, and a plurality of fins each intervening between the adjacent tubular elements, so that the duplex heat exchanger is classified in the so-called stacked type ones. It is an important feature that each tubular element is composed of two or more flat tubular segments separated from each other and each communicates with bulged header portions of the segment, whereby two or more flow paths for heat exchanging media are formed through each tubular element so that two or more unit heat exchangers are provided integral with each other in the duplex heat exchanger.

In more detail, the stacked type duplex heat exchanger provided herein comprises: a plurality of plate-shaped tubular elements; each tubular element being composed of a pair of core plates which are of complementary shapes to define two or more flat tubular segments in said element; each core plate having bulged header portions such that the core plates combined with each other do form a plurality of flow paths for heat exchanging media; each of the flow paths formed through the tubular segments and separate from each other thereby including and communicating with the corresponding bulged header portions; and a plurality of fins each intervening between the adjacent tubular elements so that all the tubular elements are stacked in a direction of their thickness, wherein the flow paths through the adjacent tubular elements communicate one with another through the header portions, so that the flow paths constitute two or more independent unit heat exchangers integral with each other to form the duplex heat exchanger.

The unit heat exchangers formed in the duplex heat exchanger may be a condenser and a radiator combined therewith, an intercooler and a radiator combined therewith, an engine oil cooler and a radiator also combined therewith, or two unit heat exchangers of other different types. Alternatively, three or more unit heat exchangers of different types, or two or more ones of the same type, may be formed in the duplex heat exchanger.

The tubular elements may be horizontal and stacked one on another to form the duplex heat exchanger of horizontal type, or may be vertical and stacked side by side to form said heat exchanger of vertical type.

One or more cutouts may be provided in corresponding portions of the coupled flat tubular segments so as to thermally insulate one flow path from the other all extending through each tubular element.

Each fin may extend between the tubular segments of each tubular element so that the number of parts decreases and the setting of the fins in place is facilitated. One or more cutouts may be present corresponding to those formed in the tubular segments, for the same purpose as mentioned above. Those cutouts will be formed through a middle portion extending intermediate and along the lateral sides of said tubular segment.

In a case wherein one of the unit heat exchangers is a condenser, an inner corrugated fin may be inserted in each flat tubular segment serving as one of flow paths for the heat exchanging medium to be condensed, to thereby enhance pressure resistance and heat transfer efficiency. Such inner fins will divide the interior of said tubular segment into some unit paths, when the core plates are firmly and tightly adjoined one to another.

The flow paths formed through the adjacent tubular elements and communicating with each other through the bulged header portions will thus provide the plurality of the unit heat exchangers.

The heat exchanging medium supplied to one header portion of one tubular segment will flow through the flow path and then into the other header portion, whilst the other medium flowing in the same manner in the other tubular segment of each tubular element.

Simultaneously with such independent flows of the heat exchanging media, air streams will penetrate the air paths each defined between the adjacent tubular elements and including the fin, whereby heat exchange occurs between the media and the ambient air.

DETAILED DESCRIPTION OF THE PREFERRED EMBODIMENTS

Now some embodiments of the present invention will be described, all being applied to a combination of a radiator with a condenser.

The term 'aluminum' in the present specification is meant to include aluminum alloys.

[First Embodiment ]

In FIGS. 1–21 showing the first embodiment, a duplex stacked-type heat exchanger of the vertical type is provided in which a coolant flows vertically through each of tubular elements.

The plate-shaped tubular elements 1 are made of aluminum and each extend elongate in vertical direction so as to be stacked side by side. Each of corrugated fins 2 also made of aluminum intervenes between the adjacent tubular elements 1.

Figure 1:
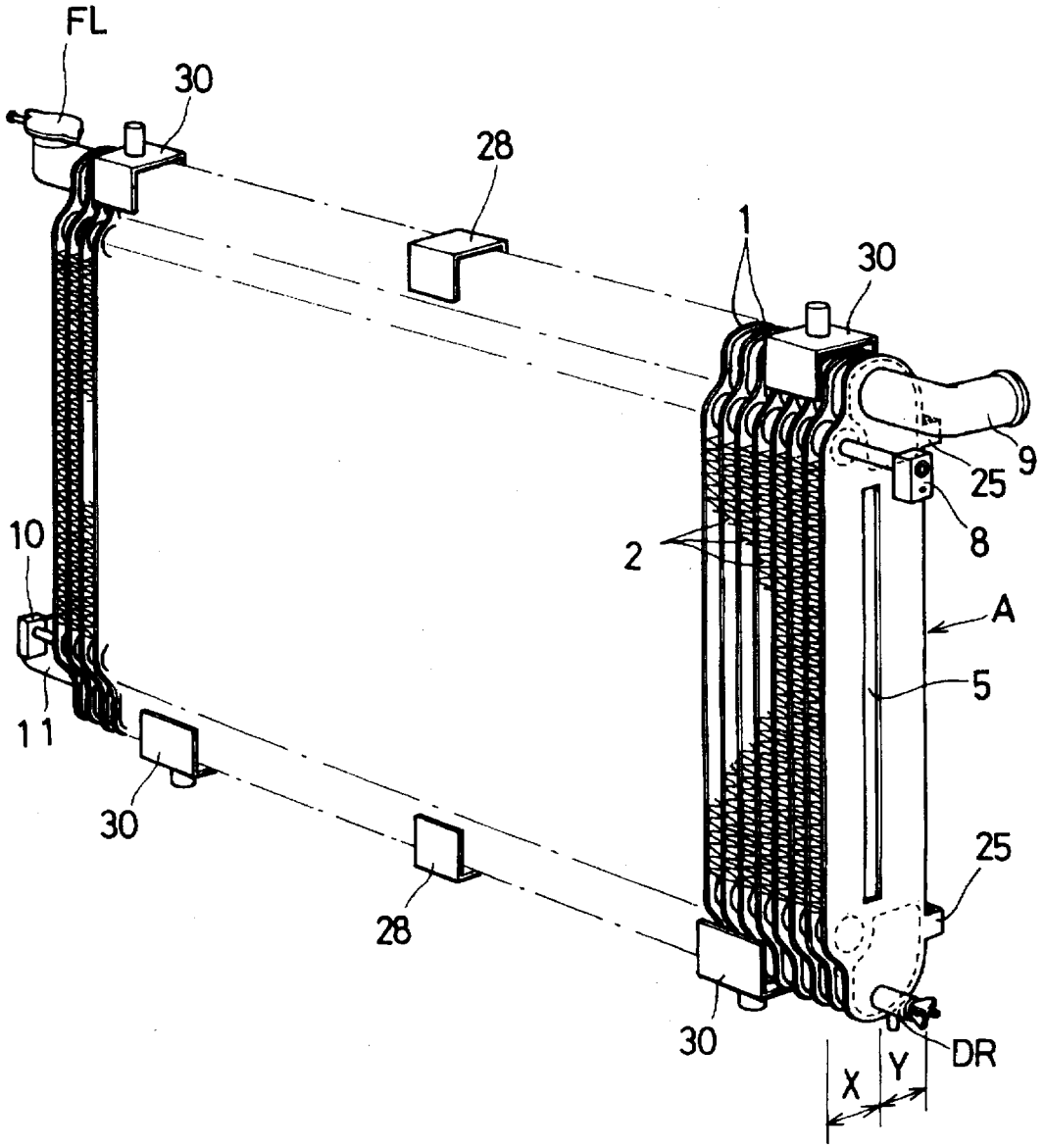
FIG. 1 is a perspective view of a duplex heat exchanger provided in a first embodiment and shown in its entirety.
Figure 2:
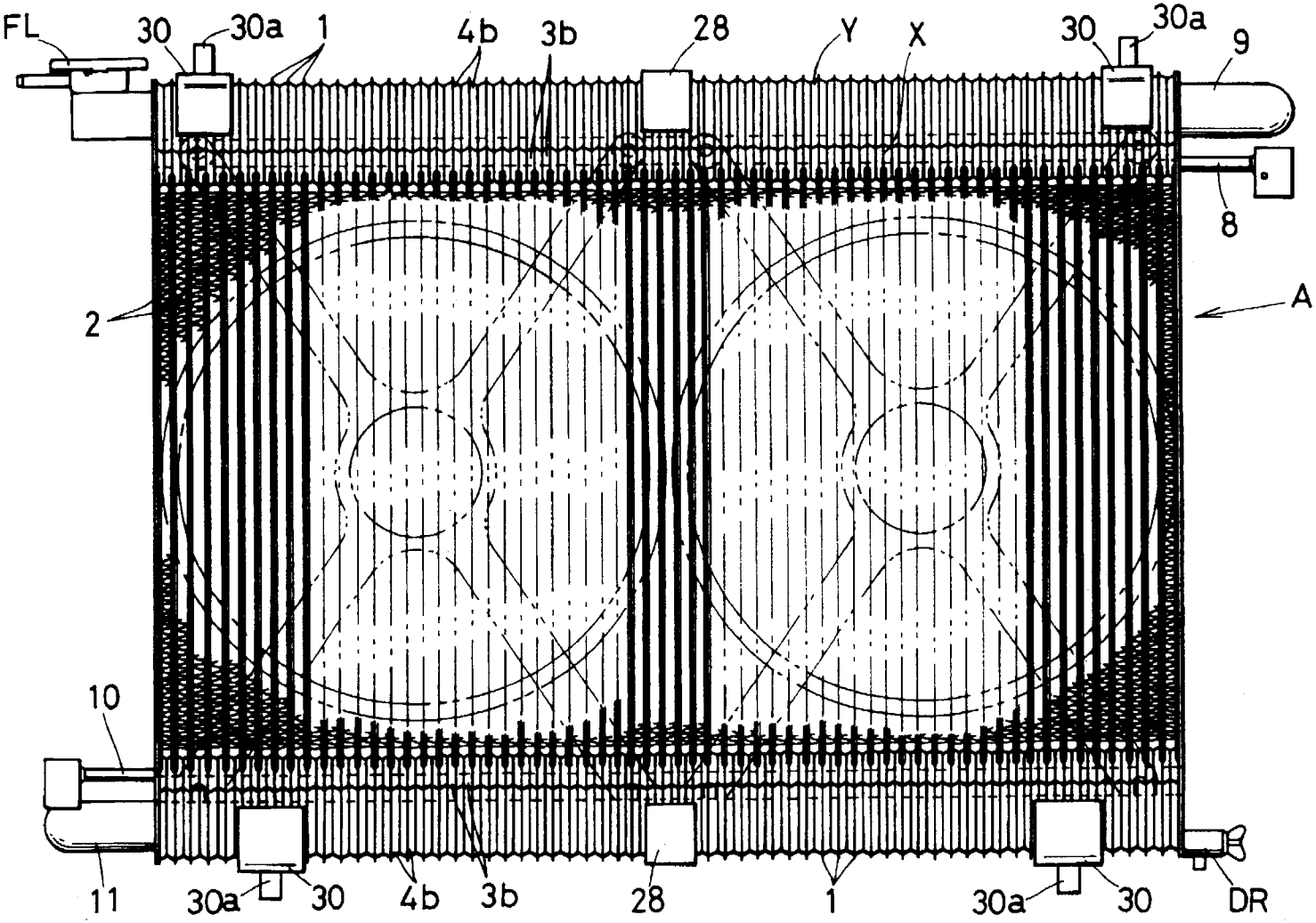
FIG. 2 is a front elevation of the duplex heat exchanger.
Figure 3:
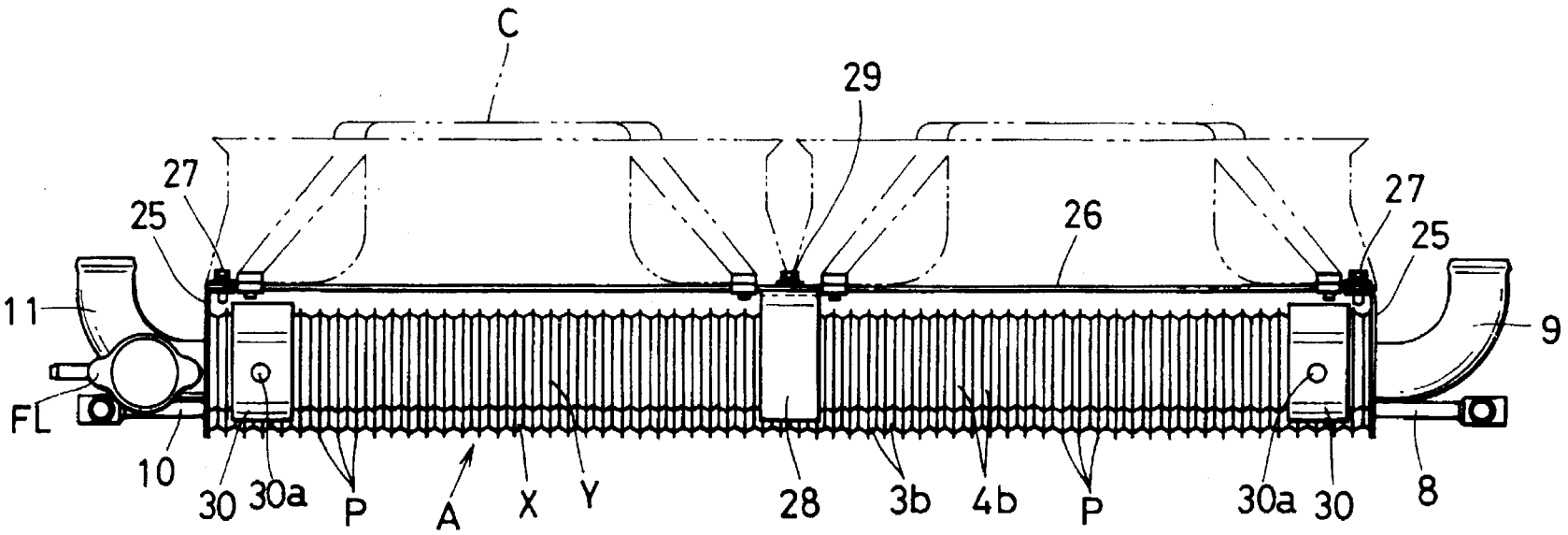
FIG. 3 is a plan view of the duplex heat exchanger.
Figure 4:
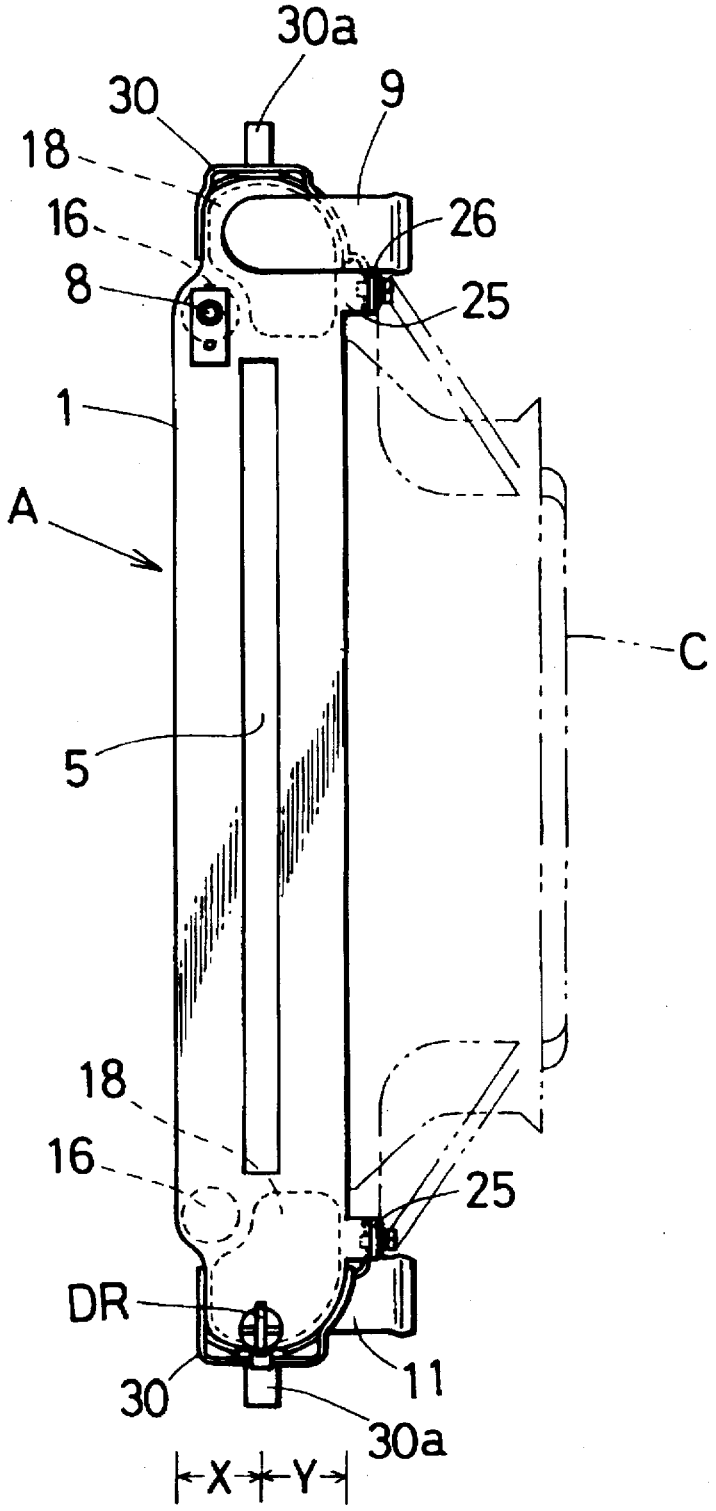
FIG. 4 is a right-hand side elevation of the duplex heat exchanger.
Figure 17:
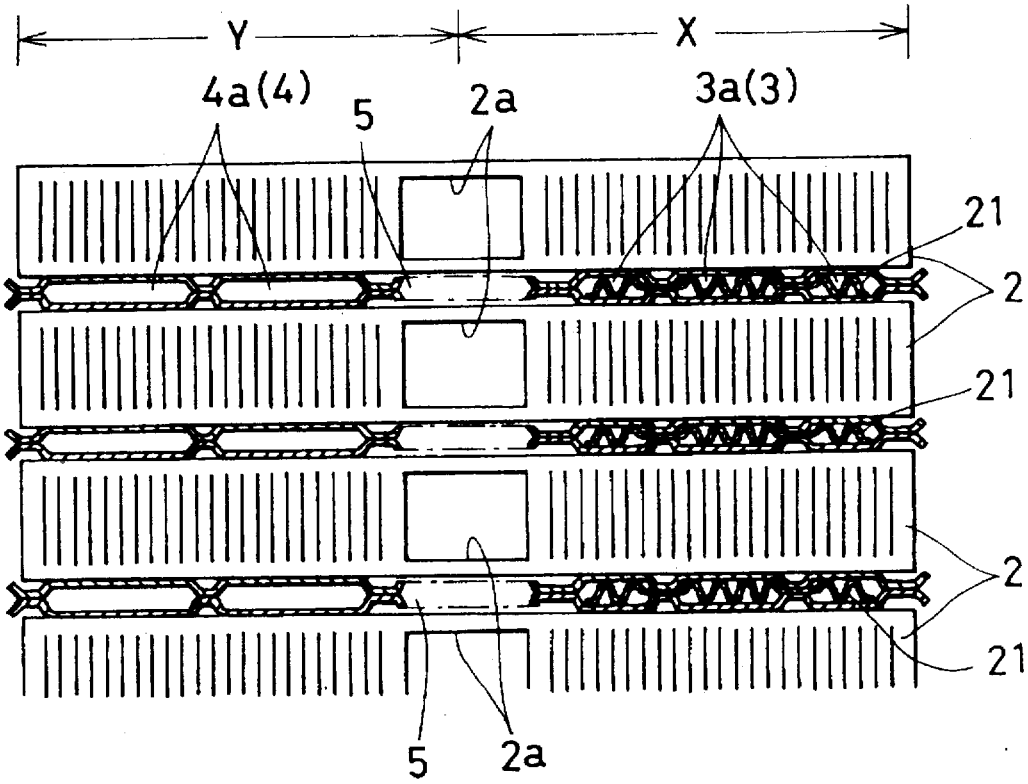
FIG. 17 is an enlarged vertical cross section of said heat exchanger body.

As shown in FIGS. 1 and 17, each tubular element 1 is composed of independent flow paths 3 and 4 which are integral with each other and extend between lateral sides of the tubular element. The flow paths 3 and 4 are formed through flat tubular segments **3*a* and 4*a*, respectively, and also through bulged header portions 3*b* and 4*b* communicating with the respective segments. The upstream flow paths 3 in the tubular elements constitute a major body of a condenser 'X', with the downstream flow paths 4** constituting a major body of a radiator 'Y'.

In order to interrupt the heat transfer between the tubular segments **3*a* and 4*a* in each tubular element, a longitudinal cutout 5 is opened formed intermediate said segments 3*a* and 4*a***.

As shown in FIGS. 10 to 13, the adjacent tubular elements 1 are tightly brazed to each other, at their header portions **3*b* and 4*b*. Openings 6 and 7 respectively formed through said header portions 3*b* and 4*b*** cause the adjacent header portions to be in fluid communication with each other.

Each tubular element comprises a pair of elongate dish-shaped core plates 'P'. Those core plates are of mirror image shapes and brazed at their peripheries one to another to provide the integral tubular element 1.

The core plates 'P' are prepared efficiently by pressing raw aluminum plates. These aluminum plates are preferably certain brazing sheets each consisting of a core sheet having a front and back surfaces clad with a brazing agent layer. Due to the brazing agent layer, the core plates can readily and surely be brazed integral with each other to provide the tubular elements, which in turn are easy to braze one another and also to the fins.

Figure 6:
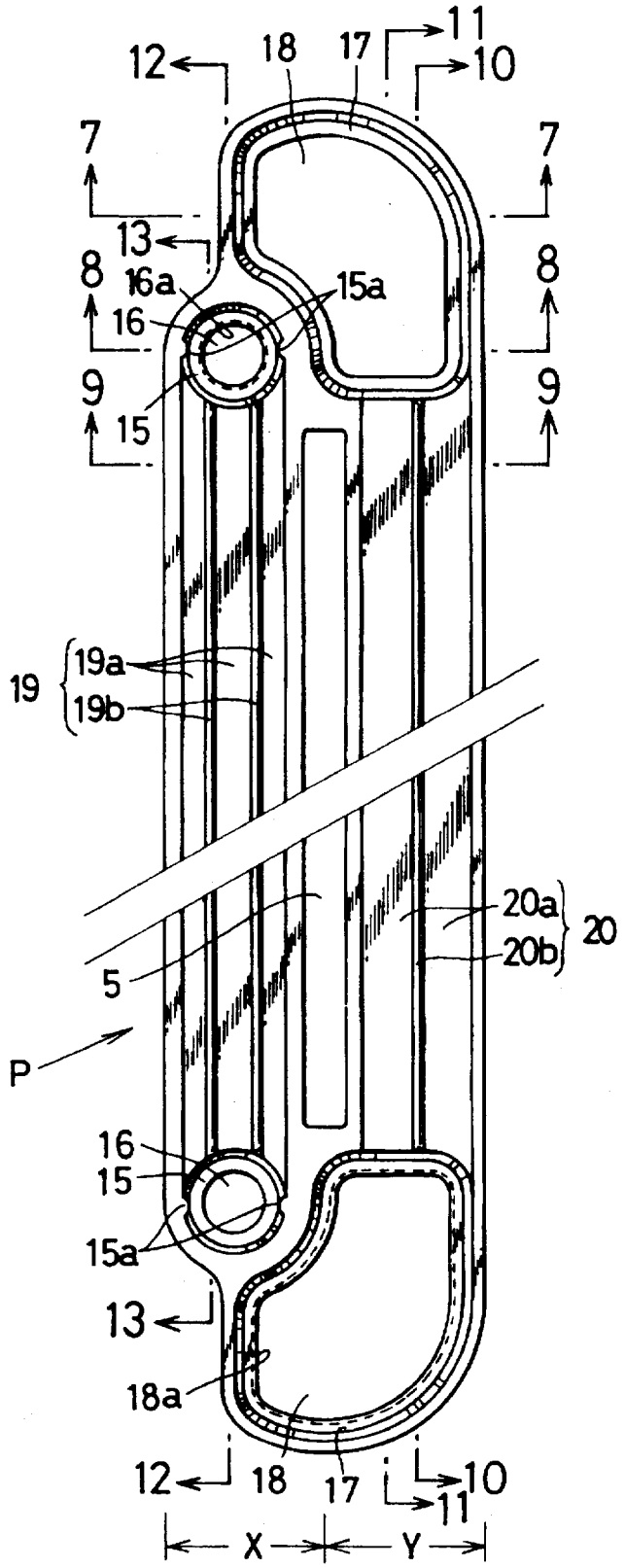
FIG. 6 is a plan view of one of core plates constituting one tubular element, with a portion thereof being abbreviated.
Figure 7:
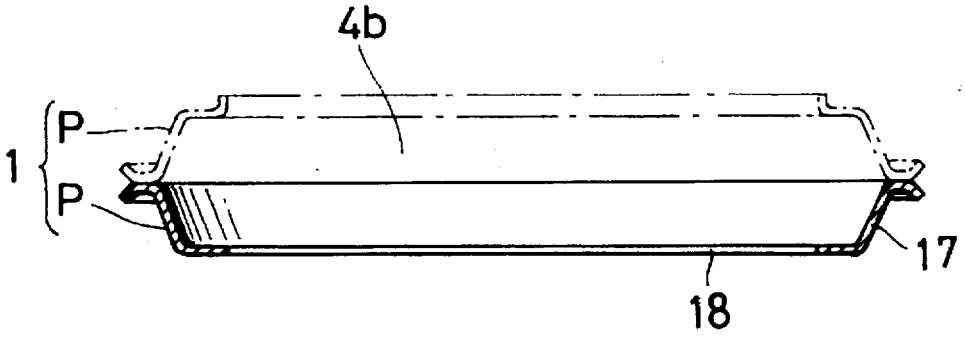
FIG. 7 is an enlarged cross section taken along the line 7—7 in FIG. 6.
Figure 8:
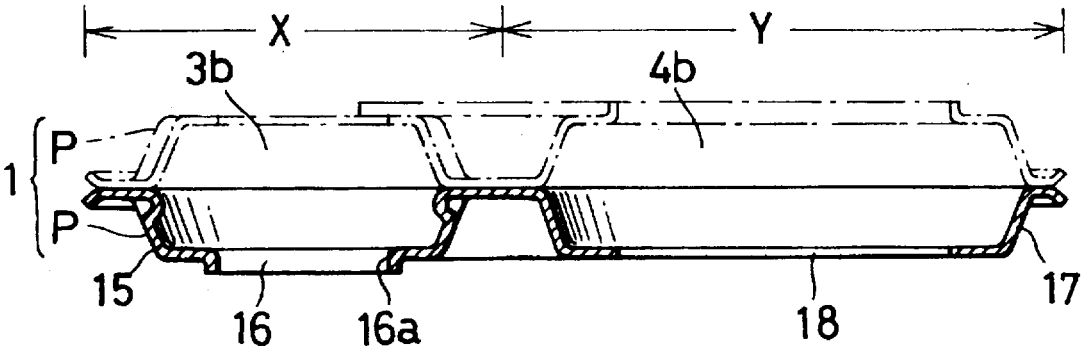
FIG. 8 is an enlarged cross section taken along the line 8—8 in FIG. 6.

As shown in FIG. 6, each core plate 'P' is an elongate article having opposite ends rounded. One lateral side portion of each rounded end is cut off the core plate, to thereby assume a recessed step-shaped shoulder.

A round bulged lug 15 protrudes perpendicular to the core plate, from the basal minor region of each rounded end of the core plate 'P' and proximal the step-shaped shoulder. Round holes 16 are opened through the summits of bulged lugs 15. A round collar 16*a* is formed along the periphery of one round hole 16, so as to protrude sideways perpendicular to the core plate.

An asymmetric and somewhat elongate bulged lug 17, which is larger than the round lug 15, protrudes in the same manner as this 15 from the remaining major region of each rounded end of the core plate 'P'. Similarly asymmetric and elongate holes 18 are opened through the summits of the elongate lugs 17. An asymmetric collar 18*a* is formed along the periphery of one elongate hole 18, so as to protrude sideways perpendicular to the core plate. The asymmetric collar 18*a* is present at the core plate's one rounded end opposite to the other end where the round collar 16*a* is present. The collars 16*a* and 18*a* will fit in the non-collared holes 16 and 18, respectively, when the header portions 3*b* and 4*b* of the adjacent tubular elements 1 are adjoined one to another. Thus, the tubular elements will be exactly aligned with and firmly connected to each other, such that the adjacent header portions 3*b* and 4*b* come into a liquid-tight communication one with another. Such a preassembly of the heat exchanger body 'A' will be protected from any undesirable displacement of the tubular elements 1 relative to each other, until they are brazed, thereby avoiding any defect in their brazed state.

The slot-shaped cutout 5 disposed intermediate the lateral sides of each core plate 'P' extends along a length thereof excluding the rounded ends. Belt-shaped sections 19 and 20 are disposed beside the cutout 5. Three straight and parallel flat grooves 19*a* extend from one of the round lugs 15 to the other 15. Each groove 19*a* has a bottom protruding a distance outwards from the core plate. Similarly, two straight and parallel flat grooves 20*a* extend from one of the elongate lugs 17 to the other 17. Each groove 20*a* has a bottom protruding a distance outwards from the core plate. The two adjacent grooves 19*a* are separated by one of straight ribs 19*b* protruding inwards, with the other two being also separated by the other straight rib 19*b*. The parallel grooves 20*a* are likewise separated by a straight rib 20*b* also protruding inwards.

The core plate's left-hand or right-hand half where the recessed step-shaped shoulder is disposed serves as the flow path 3 constituting the condenser 'X', whilst the right-hand or left-hand half of the core plate 'P' serves as the flow path 4 of the radiator 'Y'.

The round lugs 15 will be positioned to protrude outwards in opposite directions when two core plates 'P' are combined with each other. The elongate lugs 17 will also be positioned in the same manner, when the two core plates form one tubular element 1. As indicated by the solid lines and broken lines in FIG. 9, the ribs 19*b* facing one another in the flow path of condenser 'X' will be brazed to each other so that three elongate spaces are provided to receive and hold a single aluminum corrugated inner fin 21.

Figure 5:
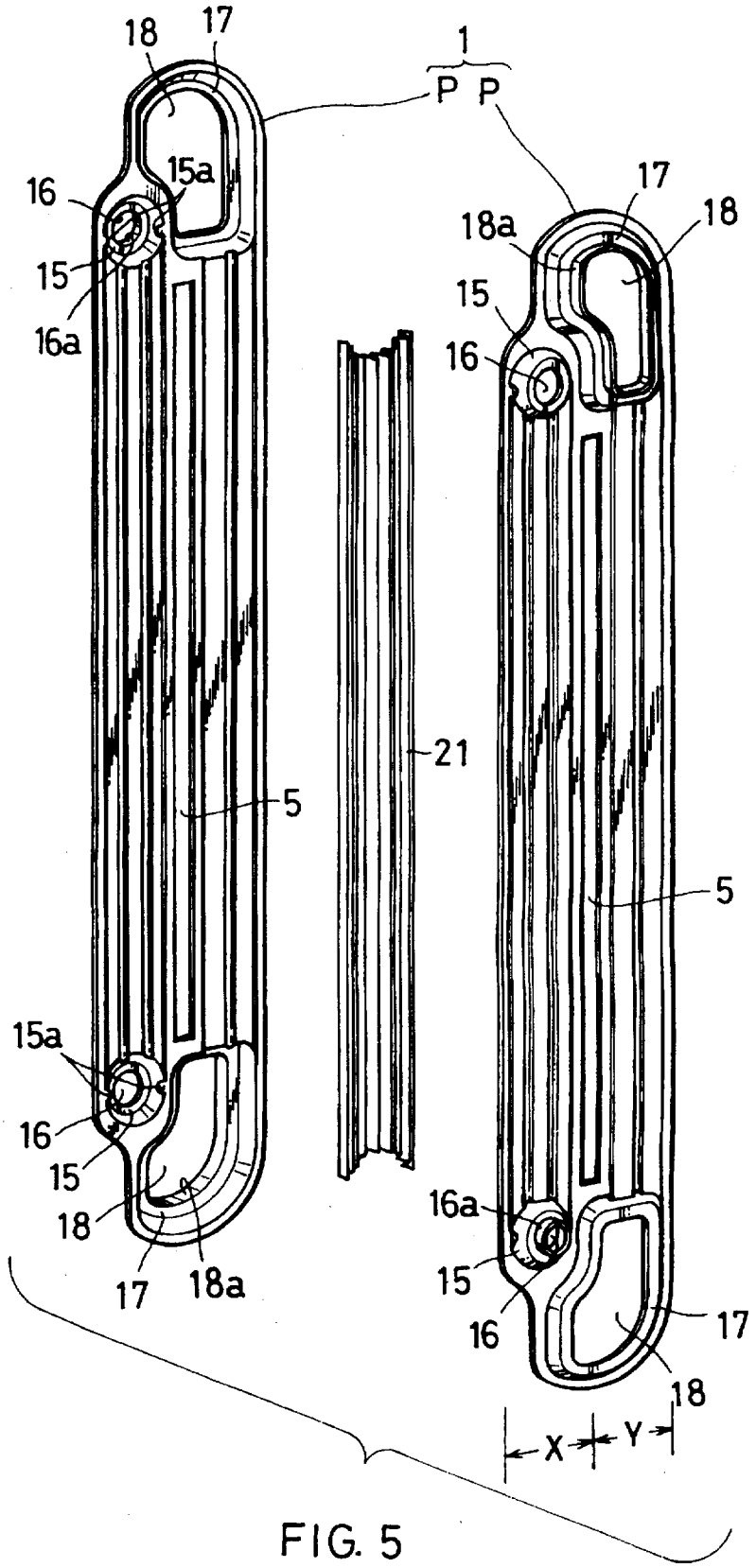
FIG. 5 is a perspective view of tubular elements included in a middle part of the duplex heat exchanger's body, and shown in their disassembled state.
Figure 14:
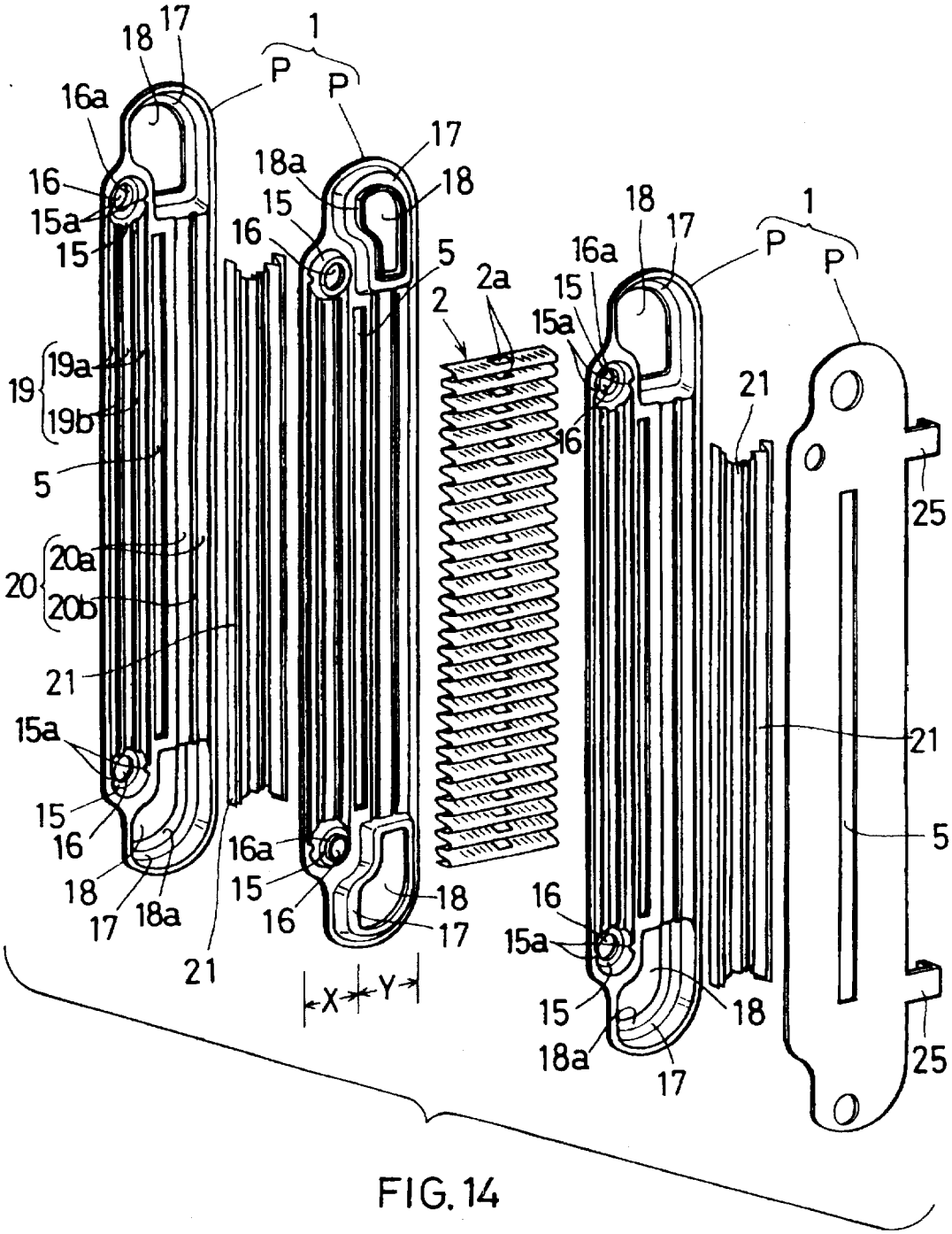
FIG. 14 is a perspective view of the outermost and the next tubular elements and a corrugated fin interposed therebetween, wherein the members constructing the heat exchanger body are shown in their disassembled state.

The inner fin 21 extends from one of the round lugs 15 to the other 15. Both ends of the inner fin are curved to fit on the inner peripheral portion of the round lugs 15, as seen in FIGS. 5 and 14. Small lugs '15*a*' protruding inwardly from said inner peripheral portion prevent the inner fin from moving longitudinally thereof. Thus, the inner fin 21 extends the full width and full length of the flat tubular segment 3*a* defining the flow path 3, when the pair of core plates 'P' are combined one with another. It will be apparent that such an inner fin 21 will be held immovably within the coupled core plates until they are brazed, and will improve the strength and pressure resistance of the segment 3*a*.

The position, number and/or shape of the small lugs 15*a* may be modified in any manner so long as the inner fin 21 can be stable and immovable within the flat tubular segment 3*a*.

Figure 9:
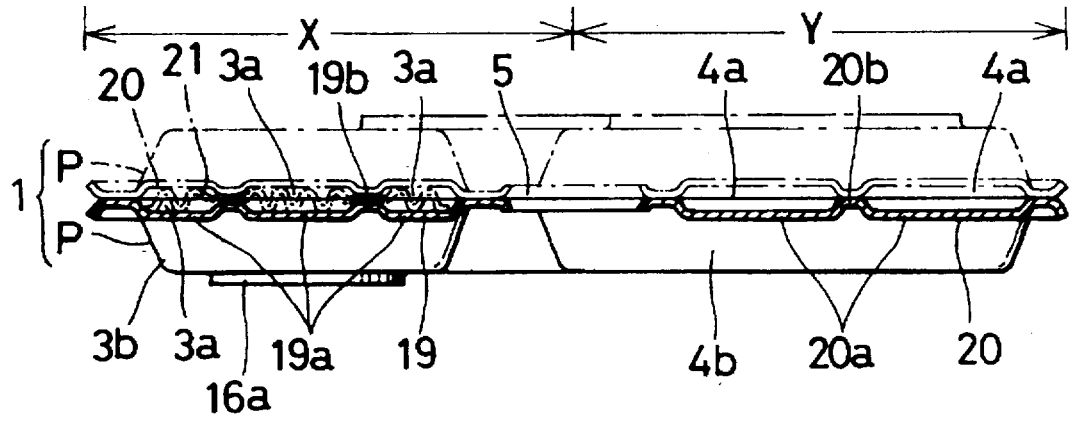
FIG. 9 is an enlarged cross section taken along the line 9—9 in FIG. 6.
Figure 10:
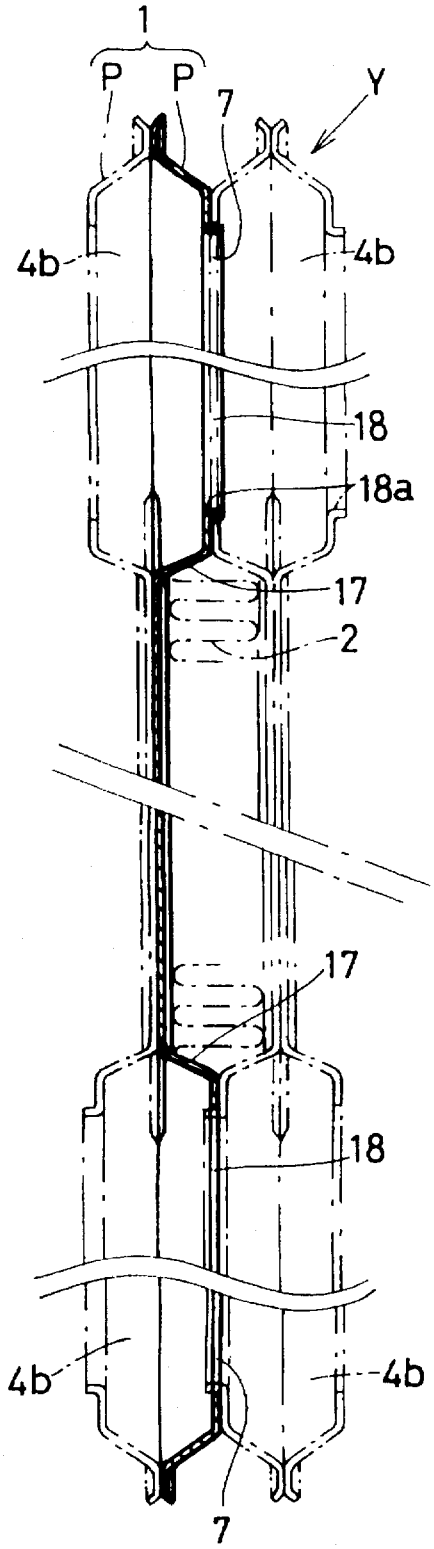
FIG. 10 is an enlarged cross section taken along the line 10—10 in FIG. 6.
Figure 11:
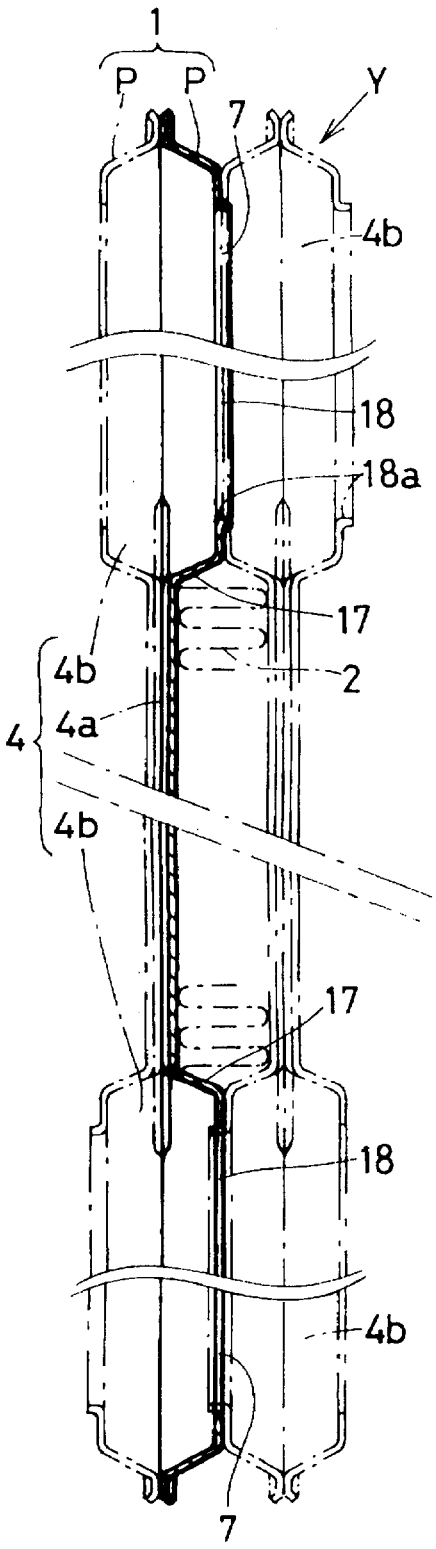
FIG. 11 is an enlarged cross section taken along the line 11—11 in FIG. 6.
Figure 12:
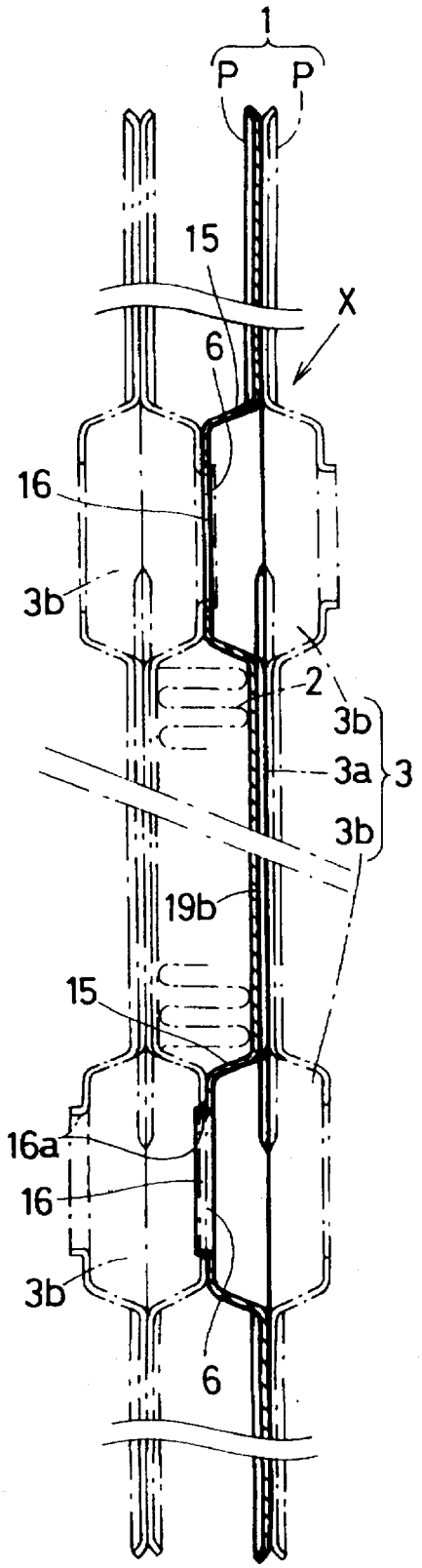
FIG. 12 is an enlarged cross section taken along the line 12—12 in FIG. 6.
Figure 13:
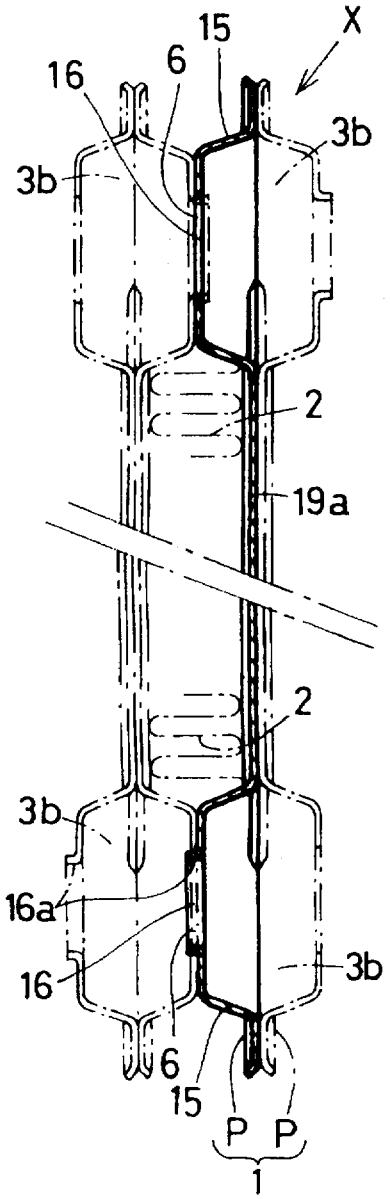
FIG. 13 is an enlarged cross section taken along the line 13—13 in FIG. 6.

As indicated by the solid lines and broken lines in FIG. 9, the ribs 20*b* facing one another in the flow path of radiator 'Y' are brazed directly to each other.

The ribs 19*b* projected inwards from the one core plate 'P' in the flow path 3 for the condenser 'X' may be arranged in a staggered relation to those projected from the other plate mating the one plate. In this alternative case, each rib 19*b* from one plate will be brazed to a flat inner face of the other plate, thereby avoiding any misalignment and defective brazing of the ribs. Notwithstanding an easier work to assemble the core plates 'P' in this case, they can be brazed more surely to enhance the strength and pressure resistance of the tubular segment. It is a further advantage that such a structure reduces the overall hydraulic diameter of said tubular segment, thus improving the heat transfer efficiency.

It will now be apparent that each tubular element 1 has at the upper and lower ends the header portions 3*b* for the condenser, and at said ends the other header portions 4*b* for the radiator. The straight flow path 3 including the inner fin 21 is thus formed to extend from the upper header portion 3*b* to the lower one 3*b*, whereas the other straight flow path 4 also extends from the upper header portion 4*b* to the lower one 4*b*. The former header portions 3*b* belong to the tubular segment 3*a*, while the latter ones 4*b* belonging to the other segment 4*a* of the tubular element 1.

As illustrated in FIGS. 10 to 13, each corrugated fin 2 is tightly sandwiched by and between the adjacent tubular segments 3*a* facing one another, and also between the segments 4*a* of the element 1. The adjacent header portions 3*b* and 3*b* are brazed one to another, and the fin 2 is brazed to the segments 3*a* and 4*a*. By virtue of the holes 6 and 7, the adjacent header portions 3*b* and 3*b* communicate one with another. The other adjacent header portions 4*b* and 4*b* also communicate one with another. In this manner, the stacked-type duplex heat exchanger comprises the first unit heat exchanger located at one side and serving as the condenser 'X', in addition to the second one located at the other side and serving as the radiator 'Y'.

FIG. 14 shows that the outer core plate 'P' in each of the outermost tubular elements 1 of the heat exchanger body 'A' is flat but of the same contour as the other regular core plates. The outer core plates may alternatively have pressed and bulged portions, similar to those in the regular core plates.

FIGS. 1 to 4 show that inlet pipes 8 and 9 are connected to the right-hand and upper outermost header portions 3*b* and 4*b* respectively belonging to the first and second unit heat exchangers 'X' and 'Y'. Fed to those unit heat exchangers through those inlet pipes 8 and 9 are an uncooled coolant and an uncooled water, respectively. Outlet pipes 10 and 11 are connected to the left-hand and lower outermost header portions 3*b* and 4*b* respectively belonging also to the first and second unit heat exchangers. Discharged from those unit heat exchangers 'X' and 'Y' through the outlet pipes 10 and 11 are the coolant and the water, respectively, which will have been cooled in this duplex heat exchanger.

Figure 15:
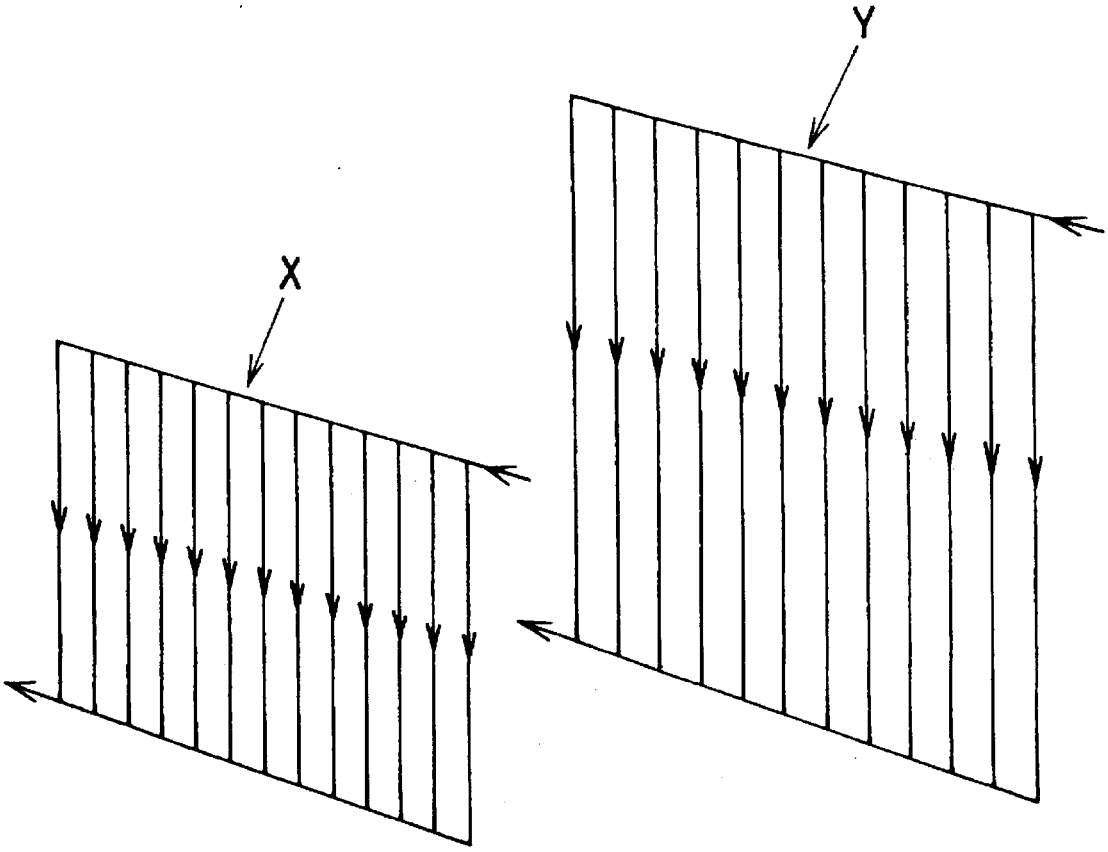
FIG. 15 is a flow diagram for a heat exchanging medium flowing through the duplex heat exchanger.

FIG. 15 illustrates that the coolant and the water entering in harmony the unit heat exchangers 'X' and 'Y' through the respective inlets 8 and 9 do flow vertically and downwards, through the discrete flow paths formed in one side and the other of each tubular element, before leaving the unit heat exchangers through the respective outlets 10 and 11.

The coolant may be caused to meander through the groups of tubular element one after another, within the unit heat exchanger 'X' serving as the condenser. Those meandering passes may be provided by modifying some tubular elements located at desired positions such that each of them has one core plate whose bulged portion 15 has no hole 16. Alternatively, some holes 16 may be closed with caps prepared as additional parts.

As seen in FIGS. 1, 3, 4 and 14, an upper and lower L-shaped brackets 25 are integral with and protruding from one lateral side of the outermost core plate 'P'. Each of stays 26 is bolted by a bolt 27 at its ends to the left-hand and right-hand brackets 25. A middle portion of each stay 26 is bolted by a bolt 29 to an upper or lower center bracket 28 fitted on the middle portion of heat exchanger body 'A'. A cooling apparatus 'C' comprising fans is secured to the stays 26.

Further left-hand and right-hand brackets 30 fit on the corresponding portions of the headers 4*b* belonging to the radiator in the body 'A'. Those brackets 30 are pressed articles and each have a pin 30*a* protruding upwards or downwards. Those pins will be fitted in respective apertures (not shown) which an object such as a motor vehicle body has, so as to secure the duplex heat exchanger thereto.

The reference symbols 'DR' and 'FL' in the drawings respectively denote a drain and a filler, both attached to the radiator headers 4*b*.

Figure 16:
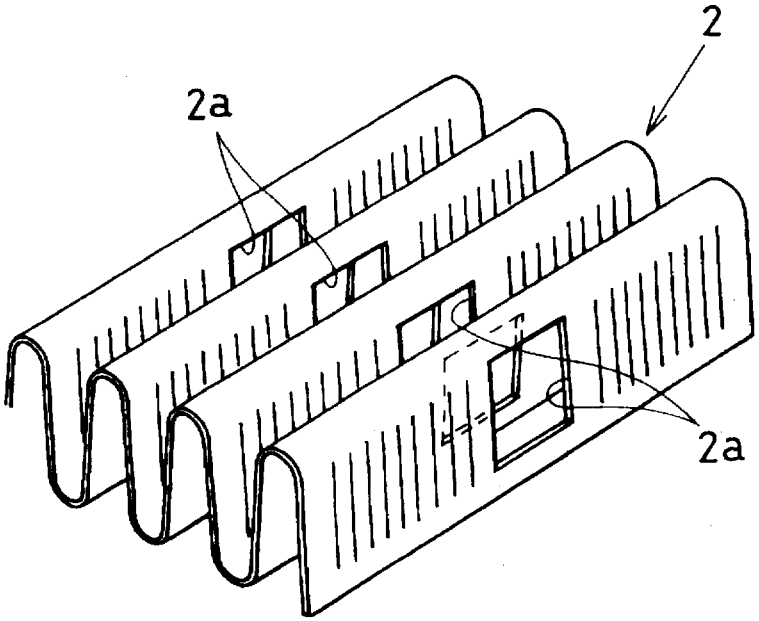
FIG. 16 is a perspective view of the corrugated fin.

On the other hand, FIGS. 14, 16 and 17 show that each corrugated fin 2 is shared in common by the two flow paths 3 and 4 formed in each tubular element 1. Rectangular cutouts 2*a* are opened through folds of the fin, such that one tubular segment 3*a* for the condenser flow path 3 is thermally insulated from the other 4*a* for the radiator flow path 4, so as not to impair the heat transfer efficiency as a whole.

Figure 18:
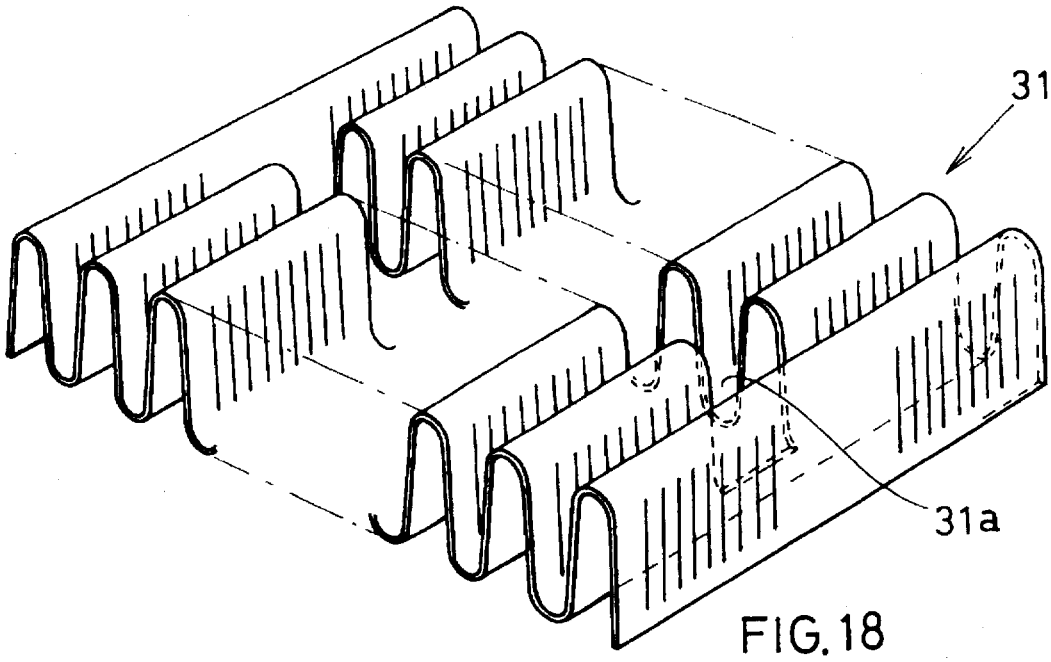
FIG. 18 is a perspective view of a modified fin.
Figure 19:
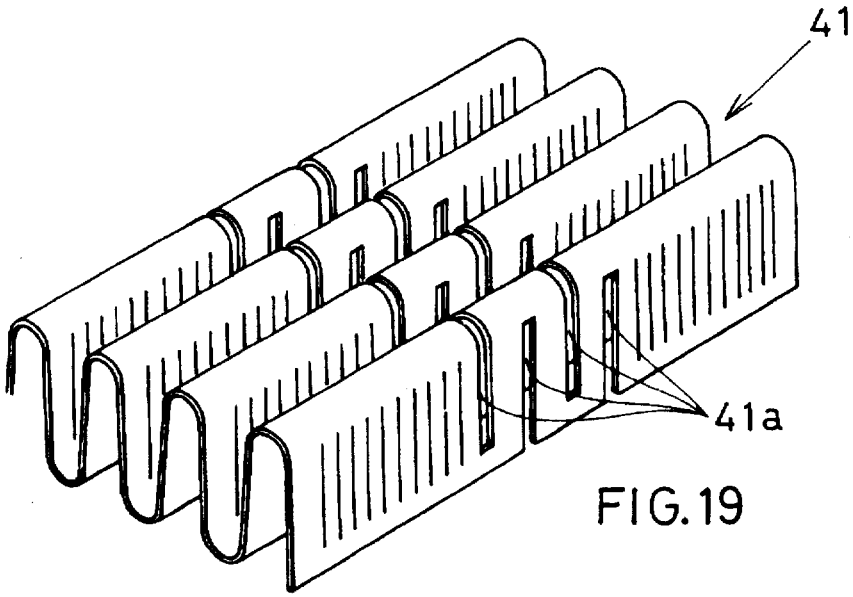
FIG. 19 is a perspective view of another modified fin.
Figure 20:
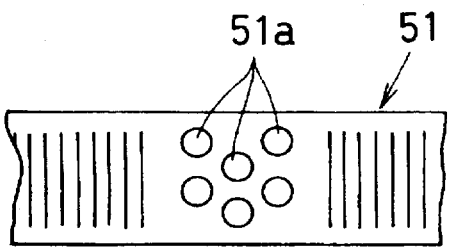
FIG. 20 is a perspective view of a further modified fin.
Figure 21:
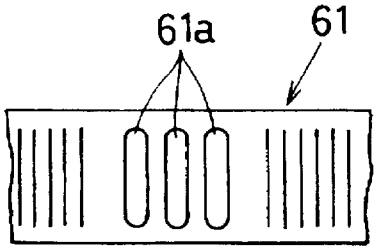
FIG. 21 is a perspective view of a still further modified fin.
Figure 22:
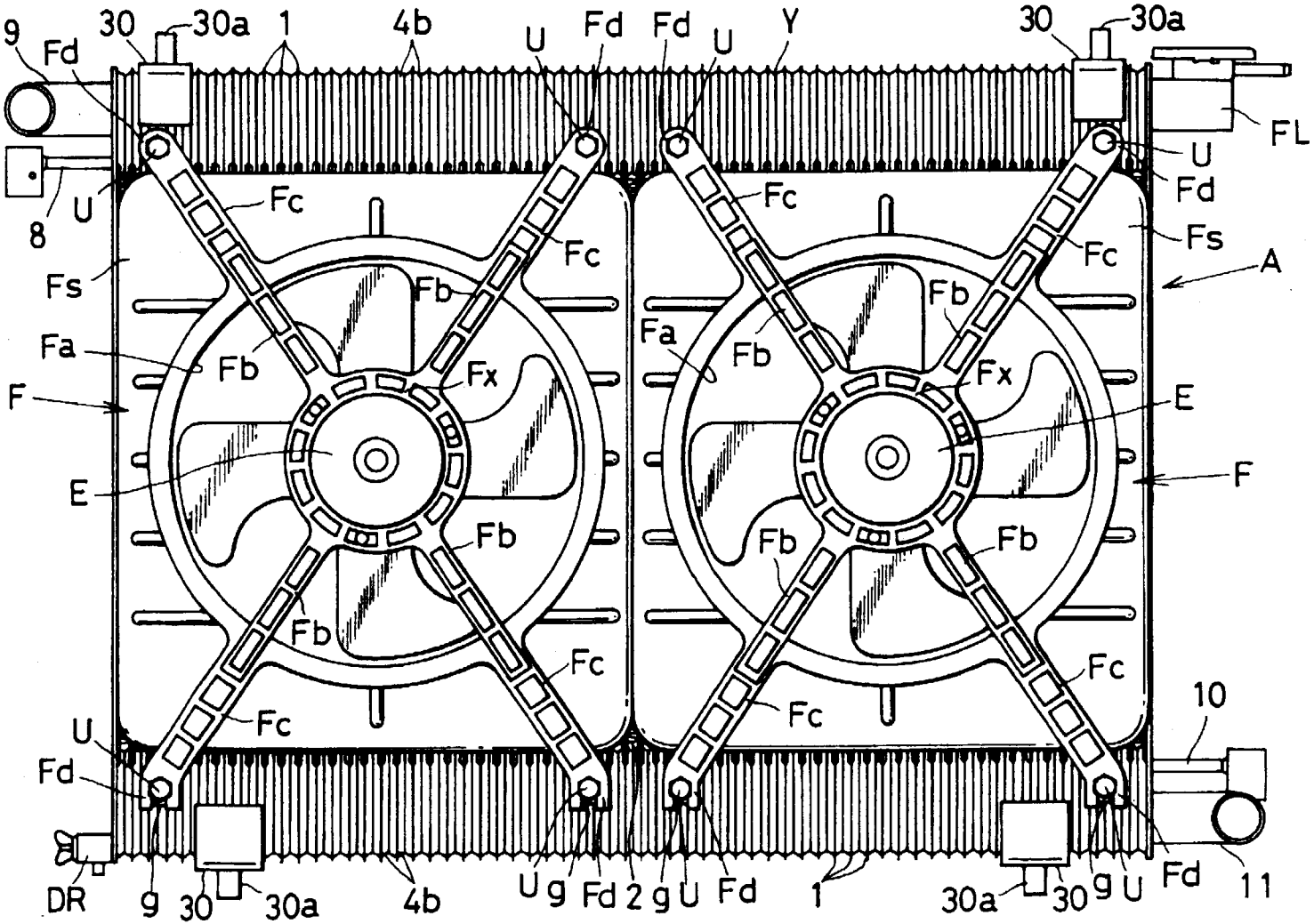
FIG. 22 is a rear elevation of a duplex heat exchanger provided in a second embodiment.

FIGS. 18 to 21 show some modified fins, wherein one 31 of them illustrated in FIG. 18 has an elongate cutout 31*a* extending from the second ridge to the 'last but one' ridge. The cutout 31*a* is located intermediate the lateral sides of the fin 31. The fin 41 shown in FIG. 19 has downward and upward slots 41*a* alternating with one another and located at middle regions of the ridges. Each ridge forming the fin 51 shown in FIG. 20 has a plurality of round holes 51*a*, whilst parallel slots 61*a* are punched off each ridge of the further fin 61 shown in FIG. 21.

All the cutouts 31*a*, 41*a*, 51*a* and 61*a* in the modified fins 31, 41, 51 and 61 are similarly effective to the thermal insulation of one flow path 3 from the other 4 respectively formed through the segments 3*a* and 4*a*.

Each fin 2, 31, 41, 51 or 61 extends between the flow paths 3 and 4, whereby it is easier to set the fins 2 etc. between the adjacent tubular elements 1 than a case wherein two discrete fins are disposed side by side between said elements.

[Second Embodiment ]

FIGS. 22 to 26 shows the second embodiment of the present invention.

The duplex heat exchanger in this embodiment has attached to its body 'A' a pair of fan shrouds 'F'. The shrouds are arranged side by side and close to the leeward face where the radiator is disposed.

The body 'A' in this embodiment is the same as that described above in the first embodiment, except for elements for holding the shrouds 'F'. The same reference numerals are allotted to the members corresponding to them in the first embodiment, to thereby abbreviate description thereof.

Each fan shroud 'F' is a one piece plastics article, as usual in the conventional types. The shroud comprises a shroud body 'Fs' which is rectangular in plan view and has a round opening 'Fa'. A fan retainer 'Fx' formed centrally of the opening, and four arms 'Fb' rigidly connect the fan retainer to the shroud body. Each arm having reinforcing ribs 'Fc' extends radially and outwardly beyond the opening to thereby provide a fastenable end 'Fd'. A fan 'E' is mounted on the retainer 'Fx'.

The fastenable ends 'Fd' located at upper left-hand and right-hand corners of each fan shroud 'F' have holes 'f' for receiving bolts or the like fasteners 'U'. The fastenable ends 'Fd' located at lower left-hand and right-hand corners have cutouts 'g' of a reversed U-shape.

Each fan shroud 'F' is fixed at its four ends 'Fd' to the heat exchanger body 'A'.

In this embodiment, a pair of tubular elements 1 located beside each fastenable end 'Fd' respectively have upper and lower hooks 'H' for retaining the fan shroud. Each hook is integral with the radiator side lateral edge of said tubular element, and protrudes therefrom towards the fan shroud 'F'.

Figure 23:
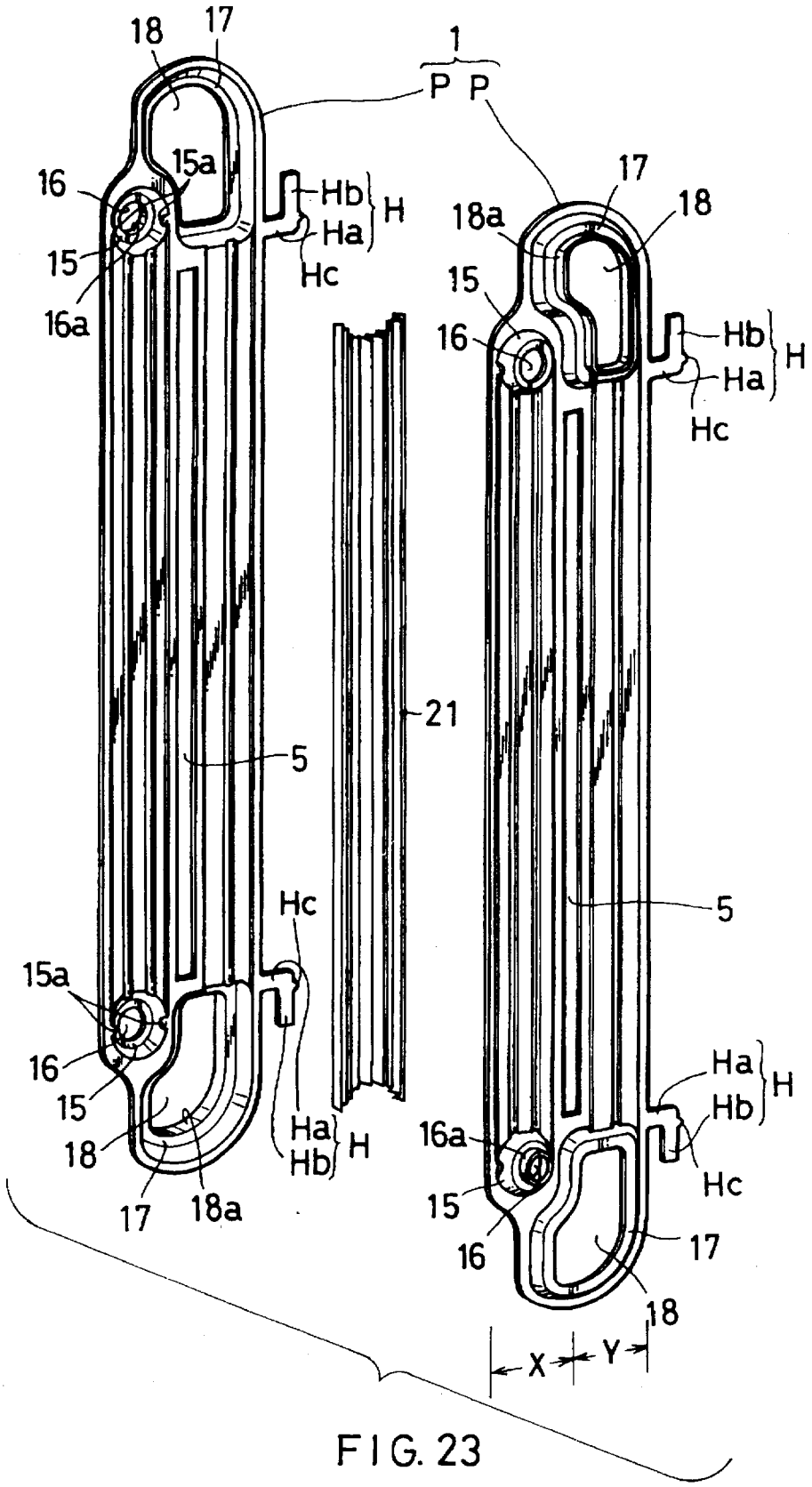
FIG. 23 is a perspective view of one of tubular elements which have lugs for holding a fan shroud.

Each tubular element 1 composed of two core plates 'P'and having such hooks 'H' is of the same structure as all the other elements, except for the hooks. As seen in FIG. 23, each of such core plates 'P' has a half constituting the upper hook 'H' substantially L-shaped in side elevation, and a further half constituting the lower hook 'H' of a reversed L-shape. Each half of the hook comprises a horizontal base 'Ha' and an upright finger 'Hb' perpendicular thereto and integral therewith. A small lug 'Hc' juts outwardly from the outer face of the upright finger 'Hb'. It is preferable that the upper and lower hooks 'H' are symmetrical with respect to a vertical center (viz. middle height) of the tubular element 1. Such an element 1, having the symmetrically arranged hooks 'H' and possibly and unintentionally placed upside down when assembling the heat exchanger body 'A', will not cause any trouble to a smooth manufacture.

The two hooks 'H' protruding from the adjacent tubular elements 1 so as to hold one fastenable end 'Fd' of the fan shroud 'F' are spaced a distance from each other.

An adapter 'K' engages with and is secured to the two adjacent hooks 'H'.

Figure 24:
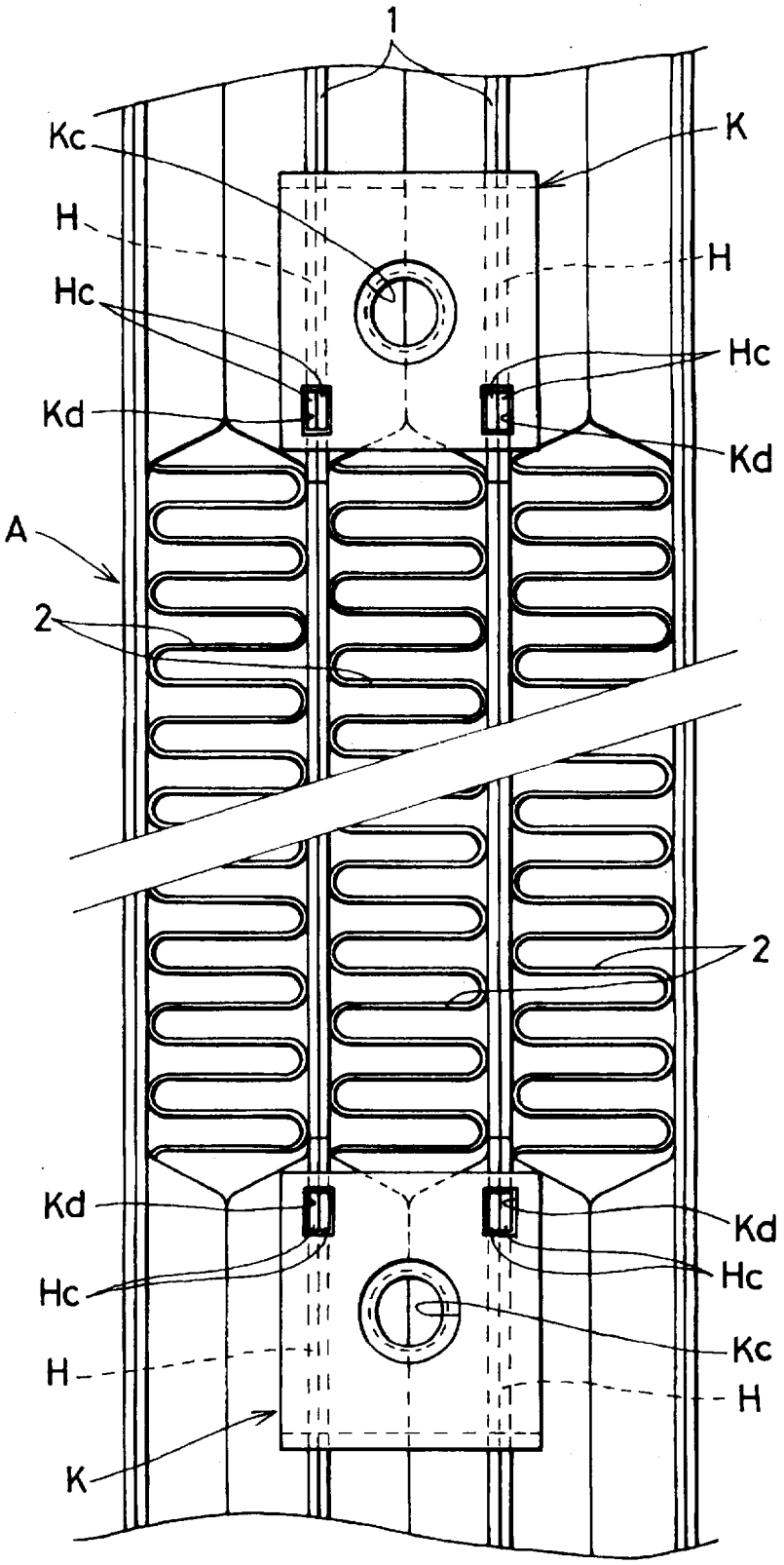
FIG. 24 is an enlarged and partial front elevation of the tubular elements whose lugs are engaged with fasteners to be attached to the fan shroud.
Figure 25:
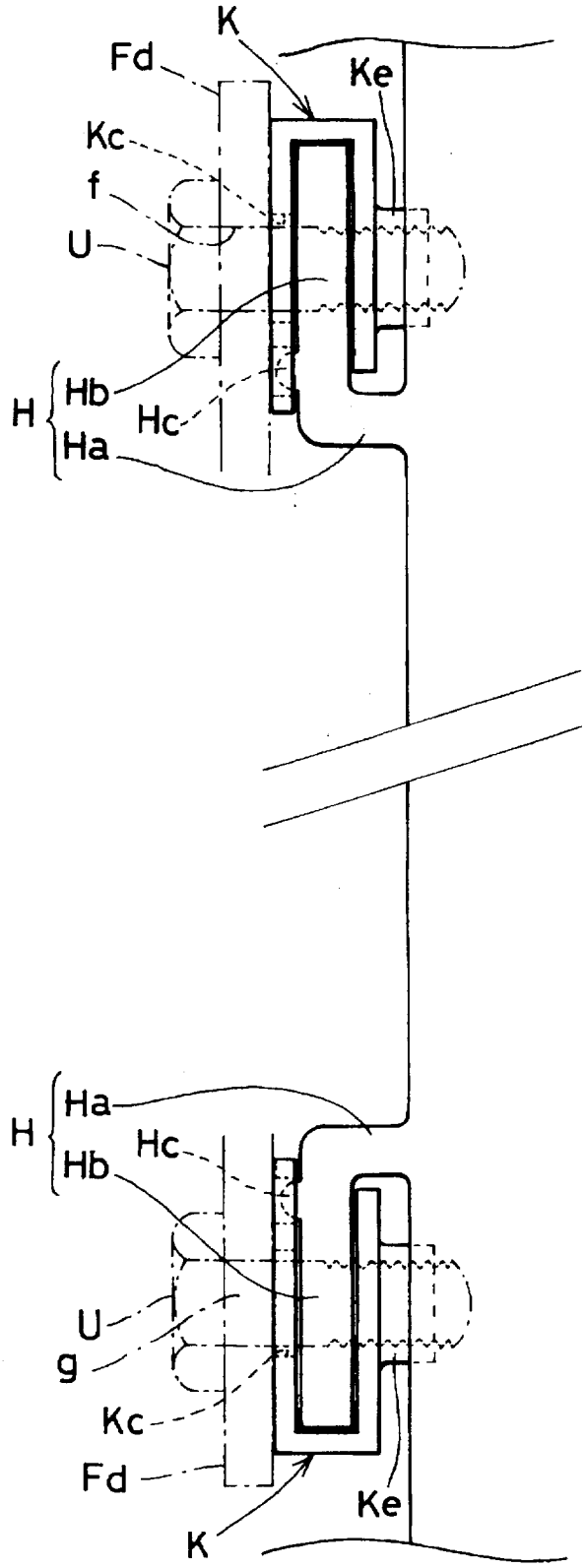
FIG. 25 is an enlarged and partial right-hand side elevation of the tubular elements whose lugs are engaged with fasteners to be attached to the fan shroud.
Figure 26:
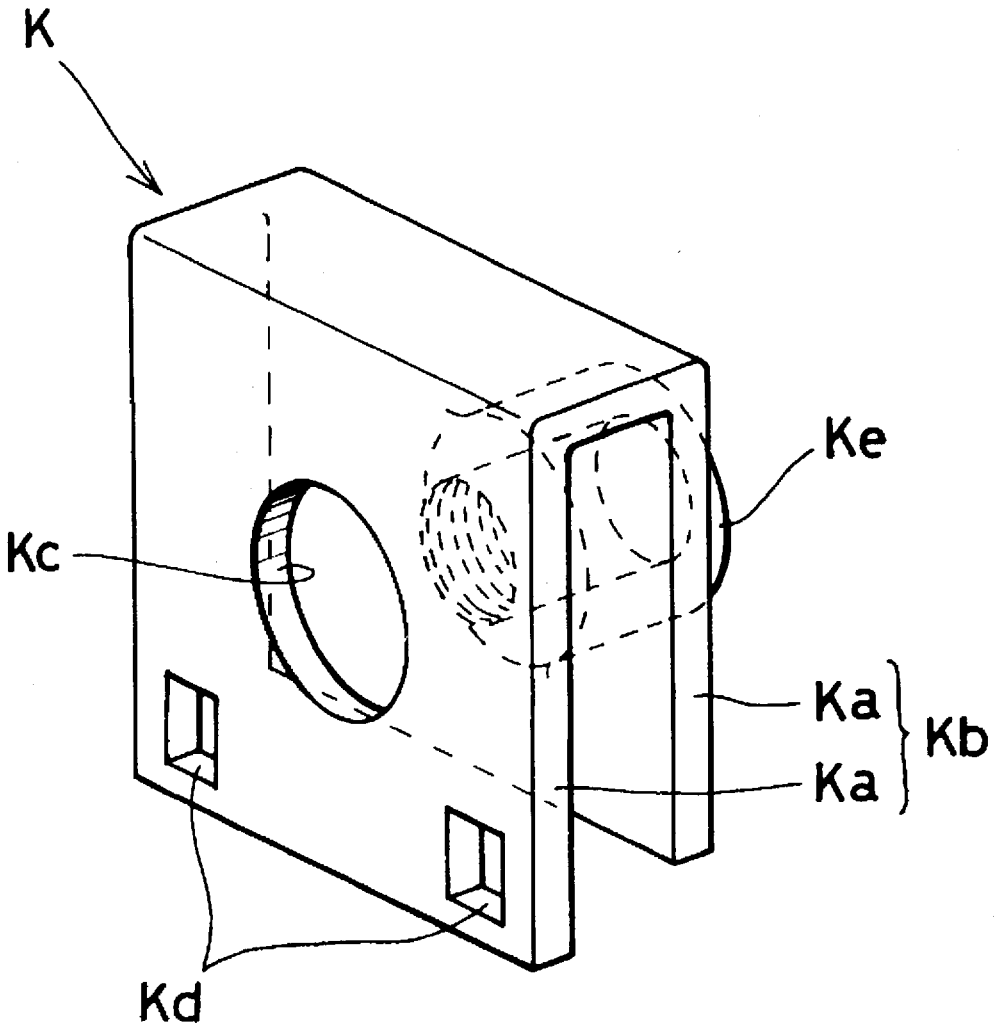
FIG. 26 is an enlarged perspective view of the fastener
Figure 27:
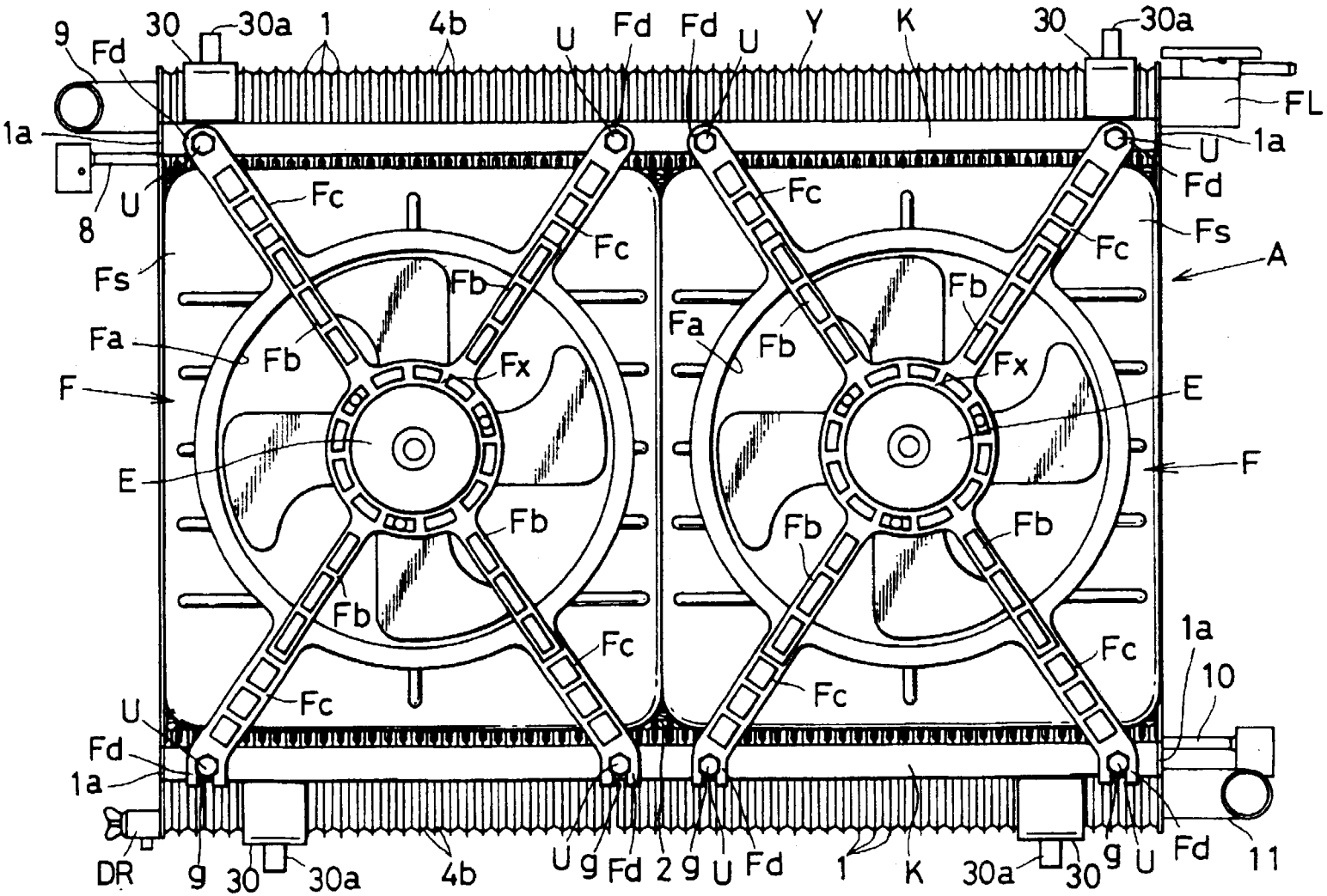
FIG. 27 is a rear elevation of a duplex heat exchanger provided in a third embodiment.

As shown in FIGS. 24 to 26, the adapter 'K' is made of a rigid plate of a transverse width to cover both the adjacent hooks 'H'. This plate is bent to form a substantially U-shaped body 'Kb', so that parallel walls 'Ka' thereof are spaced from each other a distance corresponding to the thickness of the hook's upright finger 'Hb'. One of the walls 'Ka' has a round central hole 'Kc' as well as a pair of small rectangular holes 'Kd' located near the lower corners of said wall 'Ka'. The juxtaposed small lugs 'Hc' are capable of fitting in the rectangular holes 'Kd'. A nut 'Ke' adjoined to and integral with the other wall 'Ka' protrudes away from the one wall 'Ka', so that a bolt 'U' inserted through the round hole 'Kc' of the one wall 'Ka' is fastened into the nut 'Ke'.

The U-shaped body 'Kb' of each adapter 'K' will be engaged with the upright fingers 'Hb' of two adjacent hooks 'H' and 'H', by causing the tip ends of said fingers to move deeper and deeper in between the body's walls 'Ka' until each pair of the small lugs 'Hc' snap in the adapter's small hole 'Kd' so as to unremovably fix the adapter to the hooks. It may however be possible that the adapter 'K' has small lugs forcibly fittable in small holes formed in the upright fingers of the hooks 'H'.

The bolt 'U' as a fastener will be placed through each hole 'f' or cutout 'g' of fastenable end 'Fd' and screwed in the adapter's nut 'Ke', when fixing the fan shroud 'F' to the heat exchanger body 'A'.

In detail, the mounting of said fan shrouds 'F' on said body 'A' will be carried out in the following manner.

At first, the adapters 'K' will be attached to all the pairs of the hooks 'H' protruding from the heat exchanger body 'A'. Then, the bolts 'U' will be screwed in the lower (repeatedly 'lower') adapters attached to the lower portion of said body 'A', in such state that a threaded leg of each bolt is exposed. Subsequently, each fan shroud 'F' will be placed on (the rear side of) said body such that the cutouts 'f' of lower fastenable ends 'Fd' fit on the exposed legs of the bolts 'U'. Finally, other bolts 'U' will be put in the round holes 'f' of the 'upper' fastenable ends 'Fd' and fastened into the nuts 'Ke'.

It will be understood that the hooks 'H' need not necessarily be owned only by some of the tubular elements 1, but all of them included in the heat exchanger body 'A' do have the hooks. In this case, the fan shrouds 'F' can be set at any desired place relative to the body 'A', by using appropriate ones of those hooks 'H' and the adapters 'K' attached thereto. Even two or more modified shrouds having fastenable ends 'Fd' at positions different from those illustrated in the drawings can be mounted of the heat exchanger body.

[Third Embodiment]

FIGS. 27 to 30 show the third embodiment of the present invention.

The body 'A' of duplex heat exchanger in this embodiment is principally of the same structure as those in the first and second embodiments, though all the tubular elements 1 have the hooks for holding the fan shrouds and the outermost tubular elements are slightly modified. Therefore, the same reference numerals are allotted to the members corresponding to them in the preceding embodiments, so as to abbreviate description thereof.

Although the small lug 'Hc' protrudes from the inner face of each upright finger 'Hb', the overall structure of the hooks 'H' is the same as those included in the second embodiment, as will be seen from the same reference numerals allotted to the corresponding portions.

Figure 30:
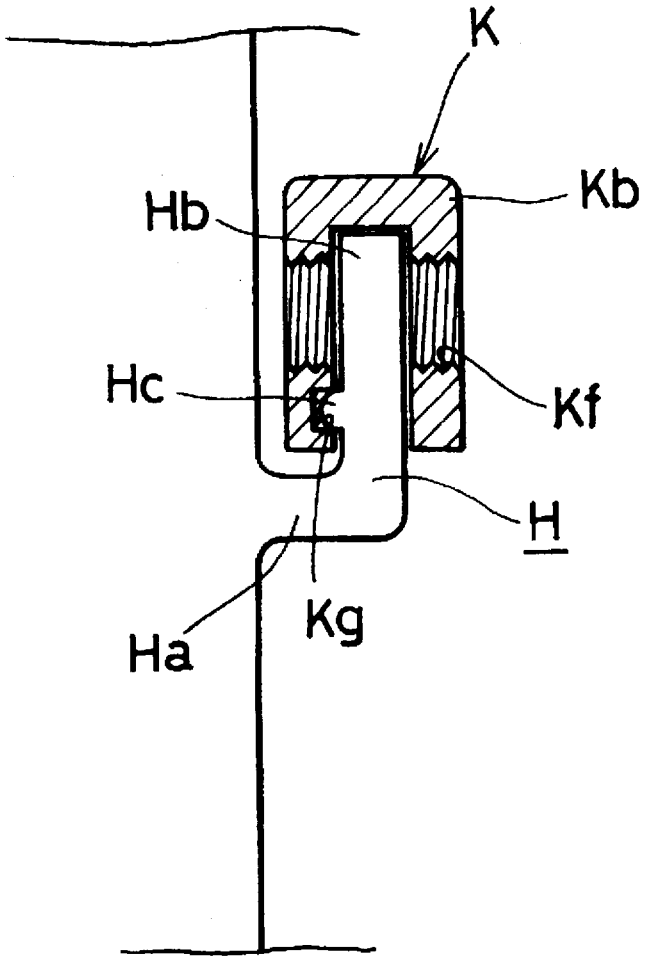
FIG. 30 is a cross section taken along the line 30—30 in FIG. 29.
Figure 31:
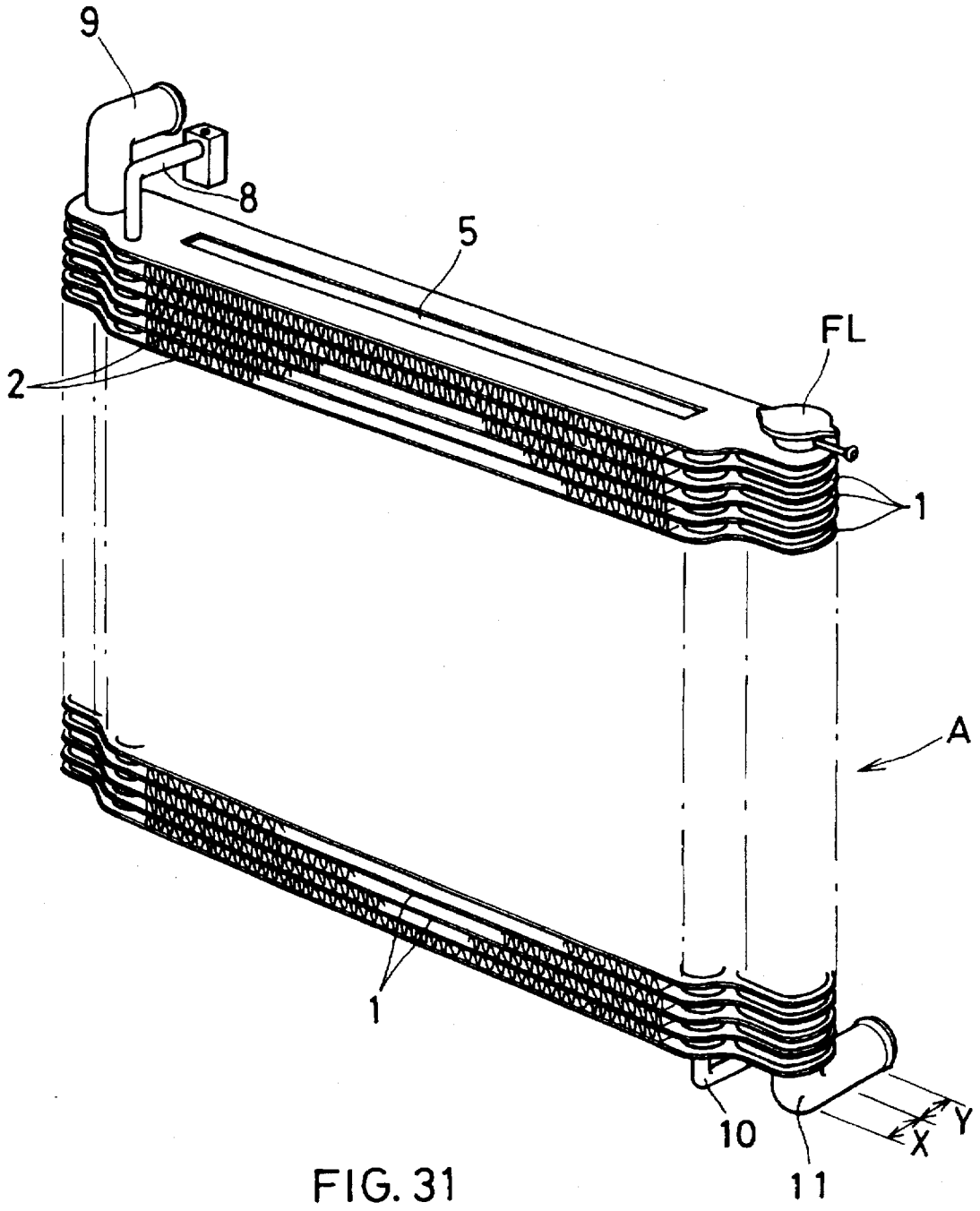
FIG. 31 is a perspective view of a duplex heat exchanger provided in a fourth embodiment and shown in its entirety.

As shown in FIG. 30, the adapter 'K' to be attached to the hooks 'H' for holding the fan shrouds in this case does consist of a U-shaped body 'Kb' alone. This adapter 'K' is an extruded band-shaped article extending an enough distance to cover the whole width of the heat exchanger body 'A'. Threaded holes 'Kf' are formed through appropriate portions of the adapter's U-shaped body 'Kb'. A groove 'Kg' is formed in and along (the inner wall of) the U-shaped body 'Kb' so as to engage with the small lugs 'Hc' of the hooks. This body 'Kb' fits on the upright fingers 'Hb' of all the hooks 'H', such that the groove 'Kg' engaging with the lugs 'Hc' prevents the adapter 'K' from slipping off the heat exchanger body 'A'. The positions of the illustrated lugs 'Hc' and groove 'Kg' can be altered so long as they contribute to the sure and immovable fixation of said adapter 'K'.

Figure 28:
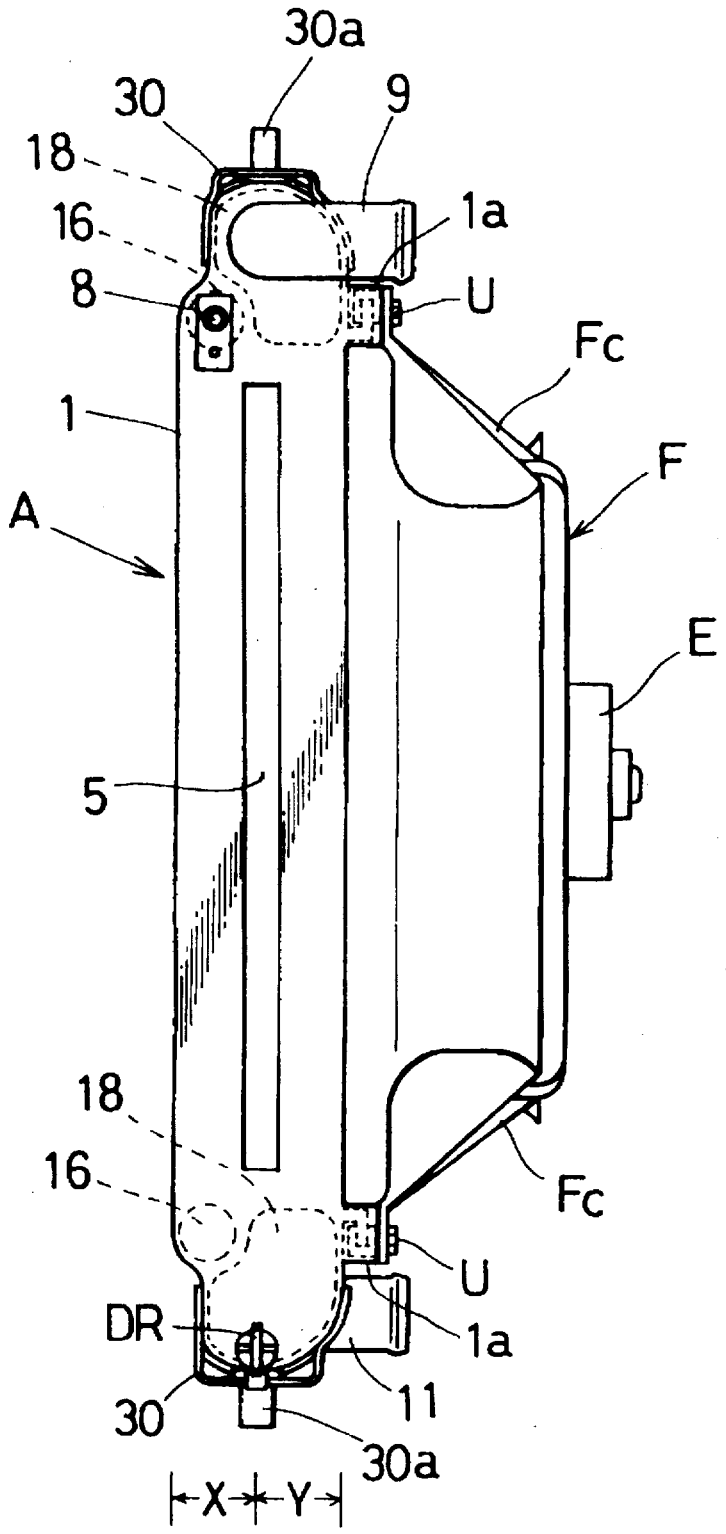
FIG. 28 is a right-hand side elevation of the duplex heat exchanger.
Figure 29:
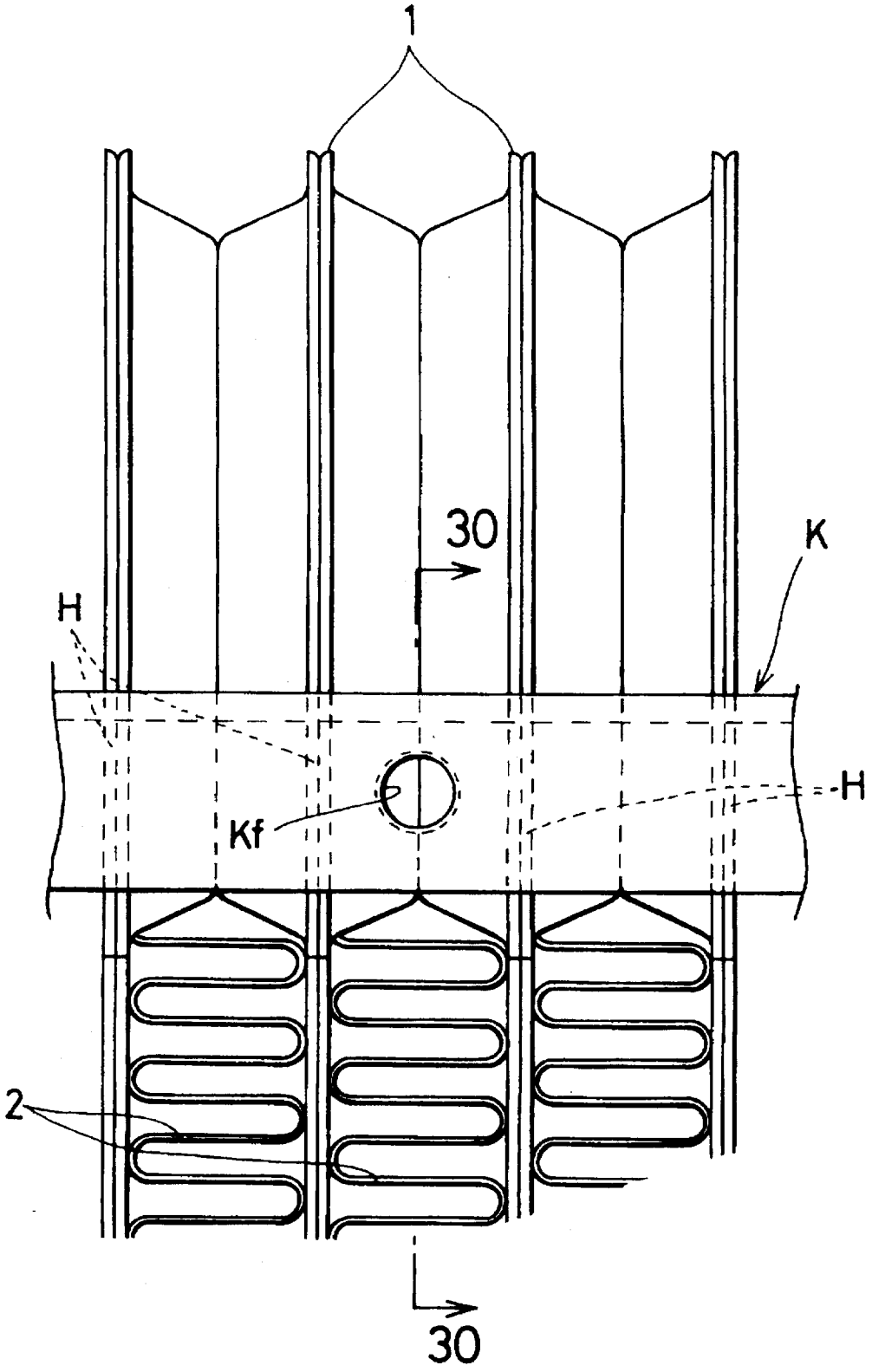
FIG. 29 is an enlarged rear elevation of a fastener and proximal members, all serving to hold a fan shroud.

Each of the outermost tubular elements 1 has an upper and lower stoppers 1*a* in contact with opposite ends of each adapter 'K', thus preventing it from moving sideways as shown in FIG. 28.

The other features are the same as in the second embodiment, and the same reference numerals are used to avoid a repeated description.

Each of bar-shaped adapters 'K' employed in the third embodiment engages with the hooks 'H' of all the tubular elements 1, so that the fan shrouds 'F' can be held in place more surely and rigidly by the heat exchanger body. The shroud's fastenable ends 'Fd' can be fixed to any desired positions along the adapters. The threaded holes 'Kf' may be formed through such adapters previously and at exact positions thereof corresponding to the actual positions of the fastenable ends, whereby any inconvenience will not be encountered despite a possible variation in the width of heat exchanger cores.

The upper and lower L-shaped hooks 'H' protruding from the tubular element in the second and third embodiment are symmetric with respect to the center thereof. However they may be modified such that their upright fingers 'Hb' extend in the same direction, preferably upwards. In such a modification, the lower fastenable ends 'Fd' of the fan shroud 'F' can directly be inserted downwards into the lower hooks 'H'. Any other modification may also be possible, without impairing the reliable connection of the adapters 'K' with the hooks 'H'. Further, the 'K' and 'H' may be brazed one to another at the same time when the other members of the heat exchanger are brazed, in order that the fan shrouds are fixed more firmly to the heat exchanger body.

[Fourth Embodiment]

FIGS. 31 to 36 illustrate the fourth embodiment of the present invention.

Similarly to the first embodiment, the duplex heat exchanger comprises a radiator and a condenser formed integral therewith.

However, the tubular elements 1 also made of aluminum and plate-shaped are arranged horizontal and stacked one on another in this embodiment so that the heat exchanging media flow sideways.

An inlet pipe 8 for feeding a coolant is connected to a left-hand end portion of the uppermost tubular element 1, and communicates with the left-hand header portions 3*b* constituting a first unit heat exchanger 'X' which serves as the condenser. A further inlet pipe 9 for feeding a cooling water is connected to another left-hand end portion of the uppermost tubular element 1, and communicates with the other left-hand header portions 4*b* constituting a second unit heat exchanger 'Y' which serves as the radiator. An outlet pipe 10 for discharging the coolant is connected to a right-hand end portion of the lowermost tubular element 1, and communicates with the right-hand header portions 3*b* of the first unit heat exchanger 'X' serving as the condenser. A further outlet pipe 11 for discharging the cooling water is connected to another right-hand end portion of the lowermost tubular element 1, and communicates with the other right-hand header portions 4*b* of the second unit heat exchanger 'Y' serving as the radiator.

Figure 32:
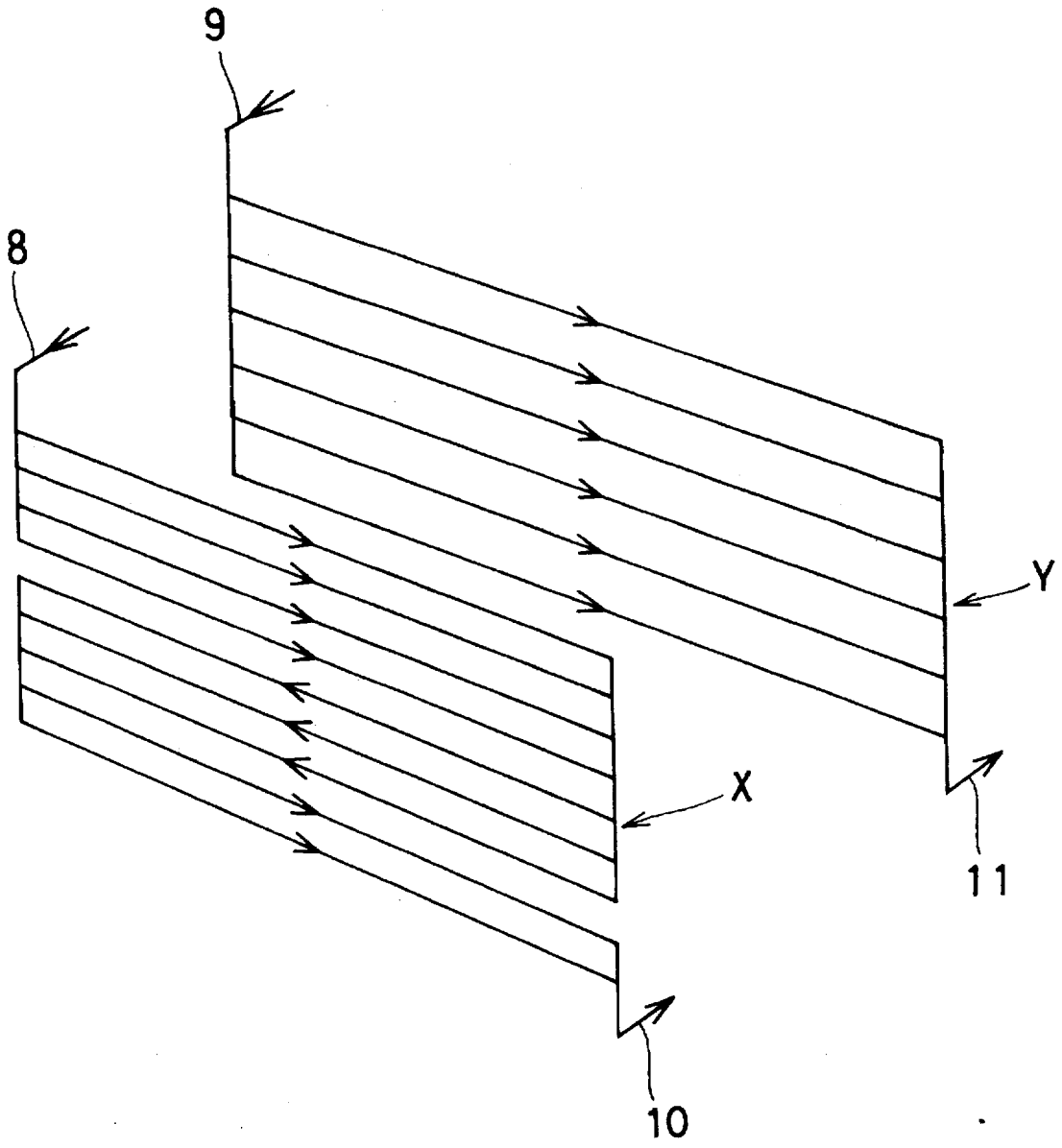
FIG. 32 is a flow diagram for a heat exchanging medium flowing through the duplex heat exchanger.

The coolant and cooling water respectively fed through the different inlets pipes 8 and 9 flows through the tubular elements 1 in a manner shown in FIG. 32. They will advance sideways and separate from one another, respectively through one side region of each tubular element and through the other side region thereof, until discharged through the different outlet pipes 10 and 11.

As seen in FIG. 32, the tubular elements have tubular segments 3*a* functioning as the one side regions, and those segments are divided into some (for example three) groups of flow paths so that the coolant meanders within the first unit heat exchanger 'X'. In order to realize such a meandering flow passageway, one of two core plates 'P' constituting each of the selected tubular elements 1 either has no hole 16 opened through its round bulged portion 15 protruding outwards, or has the hole 16 closed with a cap. It is preferable that cross-sectional area of such grouped flow paths gradually decreases as the coolant travels towards the outlet.

Figure 33:
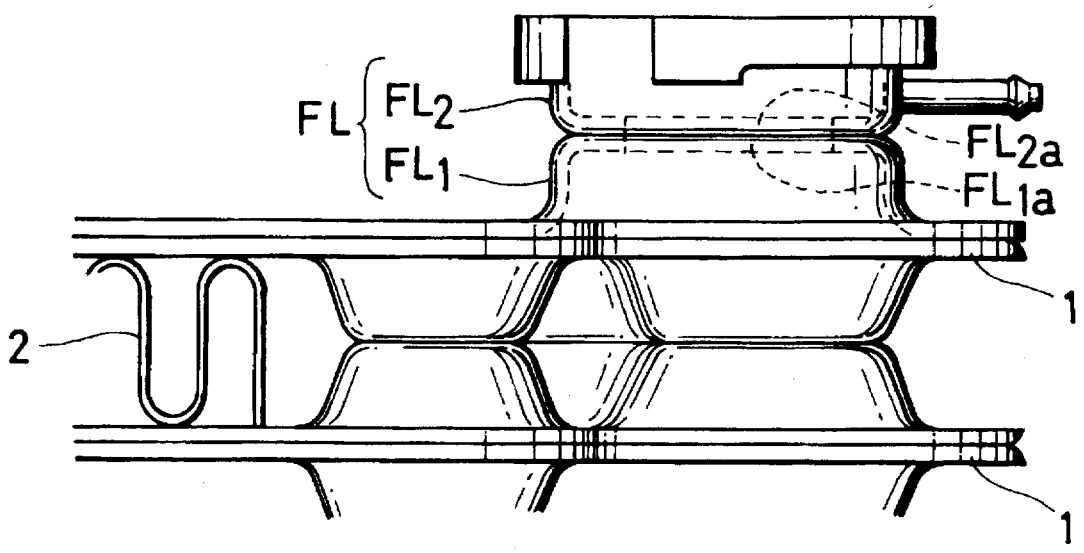
FIG. 33 is an enlarged front elevation of a filler and proximal portions present at an upper right-hand region of the duplex heat exchanger.
Figure 34:
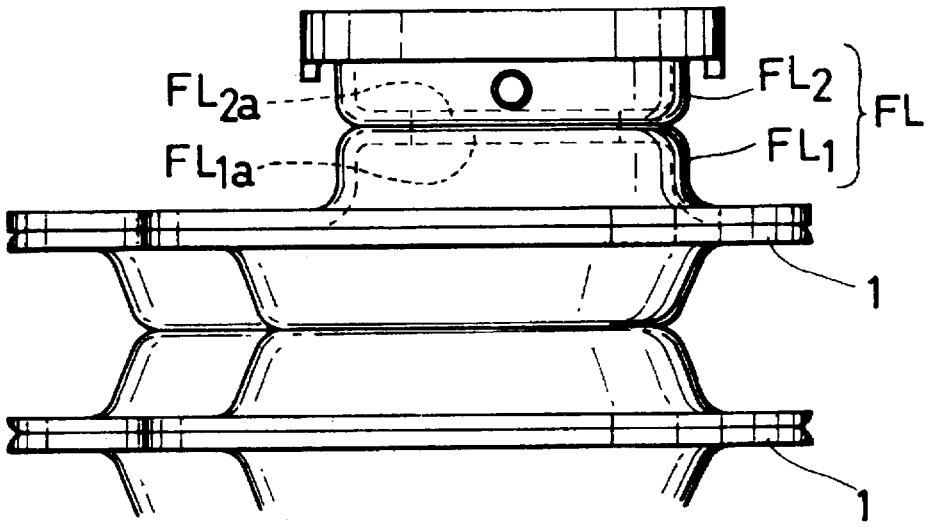
FIG. 34 is an enlarge right-hand elevation of the filler and the proximal portions.
Figure 35:
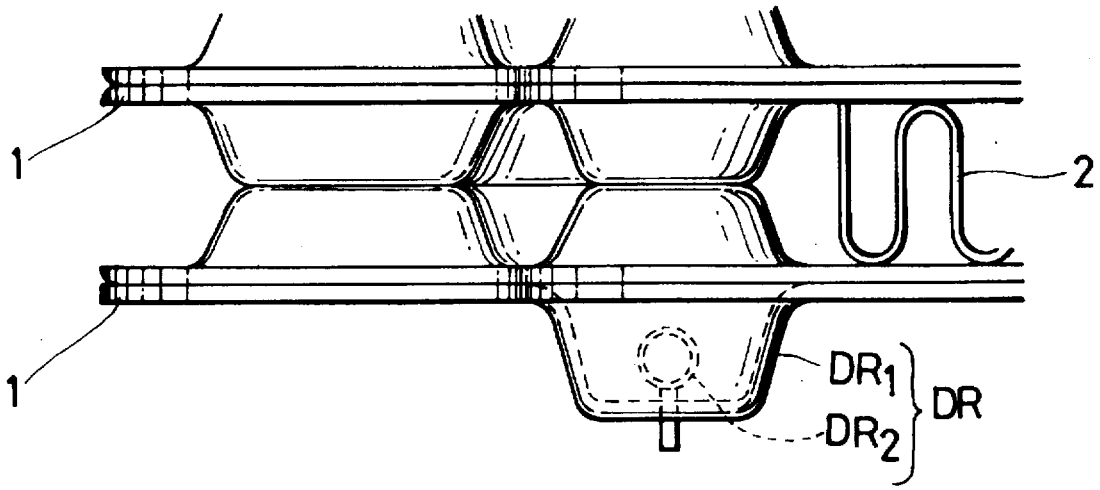
FIG. 35 is an enlarged front elevation of a drain and a proximal member both present at a lower left-hand region of the duplex heat exchanger.
Figure 36:
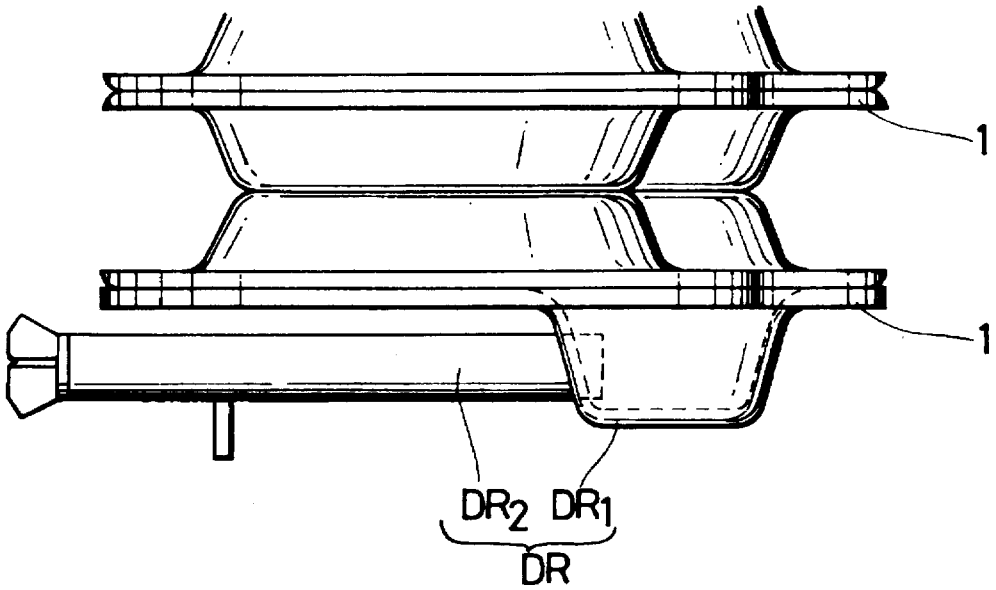
FIG. 36 is an enlarge left-hand elevation of the drain and the proximal member.

A filler 'FL' is disposed at the top of the right-hand header portion 4b which is located uppermost and belongs to the second unit heat exchanger 'Y'. The filler 'FL' may be used to fill the radiator (viz. the second unit heat exchanger 'Y') with a water. As shown in FIGS. 33 and 34, a dome '$FL_1$' is pressed out and upwards from the upper core plate 'P' of uppermost tubular element 1, and a cup-shaped filler neck '$FL_2$' is brazed to the dome '$FL_1$' so as to provide the filler 'FL'. The dome communicates with the filler neck, since holes '$FL_{1a}$' and '$FL_{2a}$' are respectively opened through the dome's top and the filler neck's bottom in contact therewith. The dome '$FL_1$' facilitates the fixing of the filler neck to the heat exchanger.

On the other hand, a drain 'DR' is disposed at the lowermost tubular element 1, and on the lower surface of the left-hand header 3b included in the first unit heat exchanger 'X' serving as the condenser. This drain 'DR' comprises a small pan '$DR_1$' protruding downwards from the lower core plate 'P' of the lowermost tubular element, and a drain cock '$DR_2$'. The small pan '$DR_1$' facilitates the fixing of the drain cock to the heat exchanger.

The other details of structure are the same as those of the first embodiment, as will be seen from the same reference numerals allotted to the corresponding portions.

The filler 'FL' and drain 'DR' disposed at the uppermost and lowermost tubular elements 1, respectively, make the horizontal type heat exchanger more convenient than the vertical type. Air purge from the upper region can be done fully and easily when pouring an added amount of the heat exchanging medium. Any noticeable amount of said medium is prevented from staying in the heat exchanger when it has to be exhausted. Several passes that can be formed through the heat exchanger for the medium will improve heat transfer efficiency, avoiding stagnation of the medium but without increasing pressure loss thereof.

The corrugated fins 2 in the embodiments may be replaced with plate fins or fins of any other type.

The unit heat exchangers 'X' and 'Y', which are arranged fore and aft in the embodiments, may however be disposed up and down provided that they are integral with each other.

The duplex heat exchanger 'A' may not necessarily be a combination of the condenser with the radiator as in the embodiments, but may be any other combination of an intercooler, radiator, engine oil cooler or the like.

In summary, each plate-shaped tubular element is a pair of core plates which define two or more tubular segments and bulged header portions, such that the segments and header portions provide two or more flow paths for heat exchanging media. Fin portions are interposed between the segments of the adjacent tubular elements, and the header portions thereof are tightly adjoined one to another. The tubular elements stacked side by side or up and down construct the integral and duplex heat exchanger, in which the discrete flow paths in one tubular element respectively communicate with those in the adjacent tubular element. Therefore, the number of parts is reduced as compared with the prior art simple aggregation of independent unit heat exchangers, whereby the present duplex heat exchanger can not only be manufactured inexpensively and more efficiently but also be designed more compact and lighter in weight.

If the tubular elements are arranged horizontally, then air purge from the upper region can be done fully and easily when pouring an added amount of the heat exchanging medium, and any noticeable amount of said medium is prevented from staying when the heat exchanger is exhausted. The passes for the heat exchanging medium, that is several groups of flow paths through the unit heat exchanger, will improve the performance thereof, avoiding stagnation of the medium but without increasing pressure loss thereof.

If the tubular elements are arranged vertically, then the heat exchanging media can flow in one direction, upwards or downwards, thereby diminishing pressure loss.

In a case wherein the one or more cutouts are provided between the adjacent tubular segments in each tubular element, undesirable heat transmission that is likely to impair performance of one or other unit heat exchanger will be avoided between the adjacent discrete flow paths which are formed through said segments.

In a case wherein the one or more cutouts are provided between the adjacent portions of each fin spanned between the tubular segments in each tubular element, undesirable heat transmission that is likely to impair performance of one or other unit heat exchanger will be avoided between the adjacent discrete flow paths which are formed through said segments.

What is claimed is:

1. A stacked type duplex heat exchanger comprising:

a plurality of plate-shaped tubular elements, wherein each tubular element of said plurality of tubular elements has a thickness such that each tubular element of said plurality of tubular elements stacked in a direction of said thickness of each tubular element of said plurality of tubular elements, and each tubular element of said plurality of tubular elements is composed of a pair of complementary shaped core plates having bulged header portions and bulged tubular portions, said core plates being placed back to back in order for said bulged header portions to form at least first and second sets of headers and said bulged tubular portions to form at least first and second flat tubular segments, said first set of headers with each header having a longitudinal axis and said second set of headers with each header having a longitudinal axis such that each of said longitudinal axes of said first set of headers is offset from each of said longitudinal axes of said second set of headers, respectively, in a direction parallel with a longitudinal axis of said core plates, said first flat tubular segment being divided from said second flat tubular segment in a direction of air flow passing through said adjacently stacked tubular elements of said duplex heat exchanger so that each said first and second flat tubular segments have at least one flow path for heat exchanging media, said at least one flow path in said first flat tubular segment being separate from said at least one flow path in said second flat tubular segment so that said at least one flow path in said first flat tubular segment only communicates with said at least one flow path in said first flat tubular segments of adjacent tubular elements through said first set of headers formed by said bulged header portions and said at least one flow path in said second flat tubular segment only communicates with said at least one flow path in said second flat tubular segments of adjacent tubular elements through said second set of headers formed by said bulged header portions, wherein said at least one flow path in said first flat tubular segment communicating with said at least one flow path in said first flat tubular segment of said adjacent tubular element through said first set of headers form a first independent heat exchanger unit and said at least one flow path in said second flat tubular segment communicating with said at least one flow path in said second flat tubular segment of said adjacent tubular element through said second set of headers form a second independent heat exchanger unit, said first and second independent heat exchanger units being formed integrally with each other to constitute said duplex heat exchanger;

at least one cutout having a long length and a narrow width in said direction of air flow passing through said adjacently stacked tubular elements of said duplex heat exchanger provided between said first and second flat tubular segments so as to thermally insulate said at least one flow path in said first flat tubular segment from said at least one flow path in said second flat tubular segment; and a plurality of fins with each fin placed between adjacently stacked tubular elements.

2. The stacked type duplex heat exchanger as defined in claim 1, wherein each tubular element of said plurality of tubular elements are stacked horizontally one on top of another.

3. The stacked type duplex heat exchanger as defined in claim 2, further comprising a filler connected to an uppermost tubular element of said plurality of tubular elements, and a drain connected to a lowermost tubular element of said plurality of tubular elements.

4. The stacked type duplex heat exchanger as defined in claim 3, wherein said filler comprises a dome integral with and protruding from an upper core plate of said uppermost tubular element of said plurality of tubular elements, and a discrete cup-shaped filler neck brazed to said dome, so that said dome communicates with said filler neck through openings that are formed through portions of said dome and said neck, wherein said dome and said neck are in contact with each other.

5. The stacked type duplex heat exchanger as defined in claim 3, wherein said drain comprises a small pan integral with and protruding from a lower core plate of said lowermost tubular element, and a discrete drain cock connected to said small pan in fluid communication therewith.

6. The stacked type duplex heat exchanger as defined in claim 1, wherein each tubular element of said plurality of tubular elements are stacked vertically side by side each other.

7. The stacked type duplex heat exchanger as defined in any one of claims 1, 2 or 6, wherein a first flow path for a first heat exchanging medium is formed along and within a first side region of each tubular element of said plurality of tubular elements so that said first heat exchanger unit which comprises said first flow path serves as a condenser, whereas a second flow path for a second heat exchanging medium is formed along and within a second side region of each tubular element of said plurality of tubular elements so that said second heat exchanger unit which comprises said second flow path serves as a radiator.

8. The stacked type duplex heat exchanger as defined in claim 7, wherein an inner fin is secured in each of said first flow paths serving as said condenser.

9. The stacked type duplex heat exchanger as defined in claim 1, wherein said core plate is made of a brazing sheet that comprises a core sheet having both surfaces clad with a brazing agent layer.

10. The stacked type duplex heat exchanger as defined in claim 1, wherein a pair of lugs protrude outwardly from first and second ends of at least one core plate having lateral sides, a slot-shaped cutout disposed intermediate said lateral sides of said at least one core plate extends along a length thereof excluding said first and second ends so that belt-shaped sections are formed beside said at least one cutout, and a plurality of straight and parallel flat grooves are formed in each belt-shaped section so as to extend from a first lug of said pair of lugs located at said first end to a second lug of said pair of lugs located at said second end of said at least one core plate, wherein each groove has a bottom protruding a distance outwardly from said at least one core plate, each groove has a bottom protruding a distance outwards from said at least one core plate, and each groove is adjacent another groove and is separated by a straight rib protruding inwardly.

11. The stacked type duplex heat exchanger as defined in claim 1, wherein each fin extends between said first and second tubular segments of each tubular element of said plurality of tubular elements, and at least one cutout is present corresponding to said at least one cutout formed in said first and second tubular segments and through a middle portion extending intermediate and along first and second lateral sides of said first and second tubular segments.

12. The stacked type duplex heat exchanger as defined in claim 1, wherein each fin of said plurality of fins is a corrugated fin made of aluminum.

13. The stacked type duplex heat exchanger as defined in claim 1, wherein hooks for holding fan shrouds are formed integrally with at least selected ones of said plurality of tubular elements.

* * * * *